US006468730B2

(12) United States Patent
Fujiwara et al.

(10) Patent No.: US 6,468,730 B2
(45) Date of Patent: Oct. 22, 2002

(54) IMAGE RECORDING MATERIAL

(75) Inventors: Toshiki Fujiwara; Rikio Inoue, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 12 days.

(21) Appl. No.: 09/330,195

(22) Filed: Jun. 11, 1999

(65) Prior Publication Data

US 2002/0015926 A1 Feb. 7, 2002

(30) Foreign Application Priority Data

Jun. 12, 1998 (JP) ..... 10-181459

(51) Int. Cl.[7] ..... G03C 1/498; G03C 1/34

(52) U.S. Cl. ..... 430/619; 430/600; 430/607; 430/613; 430/614; 430/617

(58) Field of Search ..... 430/619, 600, 430/607, 613, 614, 617

(56) References Cited

U.S. PATENT DOCUMENTS 3,152,904 A 10/1964 Sorenson et al.
3,457,075 A 7/1969 Morgan et al.
5,656,419 A * 8/1997 Toya et al. ..... 430/619
5,952,167 A * 9/1999 Okada et al. ..... 430/619

* cited by examiner

*Primary Examiner*—Thorl Chea
(74) *Attorney, Agent, or Firm*—Birch, Stewart, Kolasch & Birch, LLP

(57) ABSTRACT

Image recording materials, especially photothermographic light-sensitive image recording materials, that comprise a compound of formula (1) to acquire excellent image storage stability:

(1)

wherein $X_1$ and $X_2$ each represent a halogen atom; $X_3$ represents a hydrogen atom, a halogen atom or a univalent substituent group; L represents a divalent organic group; Y represents a divalent organic group containing a hetero atom, or a single bond; and Z represents an acidic functional group or a salt thereof.

12 Claims, No Drawings

IMAGE RECORDING MATERIAL

FIELD OF THE INVENTION

The present invention relates to an image recording material and, more particularly, to an image recording material having excellent storage stability before processing for image formation and ensuring excellent storage stability for the image formed therein.

BACKGROUND OF THE INVENTION

Photothermographic materials which form photographic images by the use of a heat-development processing method are disclosed in, e.g., U.S. Pat. Nos. 3,152,904 and 3,457,075, and Thermally Processed Silver System written by D. Morgan and B. Shely in the book entitled "Imaging Processes and Materials", edited by Sturge, V. Walworth & A. Shepp, 8th ed., p. 2 (1969).

In such photothermographic light-sensitive materials are contained a silver source capable of being reduced (e.g., an organic silver salt), a catalytic amount of photo-catalyst and a reducing agent, generally in a condition that they are dispersed in an organic binder matrix. Although they are stable at ordinary temperature, the photothermographic light-sensitive materials produce silver by the redox reaction between the silver source (functioning as oxidant) and the reducing agent when heated at a high temperature (e.g., 80° C. or above) after exposure. This redox reaction is accelerated by the catalytic action of latent image produced by exposure. Therefore, the organic silver salt in the exposed area undergoes the accelerated reaction to provide a visible silver image, which presents contrast to the unexposed area. Thus, image formation is attained.

As another material utilizing the image formation to which the similar principle to the above is applied, there is known a heat-sensitive recording material containing a silver source capable of being reduced (e.g., an organic silver salt) and a reducing agent, generally in a condition that they are dispersed in an organic binder matrix. Such a material is heated imagewise by means of a thermal head, high-power laser or the like, and the redox reaction between the silver source (functioning as oxidant) and the reducing agent proceeds in proportion to the quantity of heat applied, thereby producing silver as visible image.

The recent progress of image recording arts have been made mainly aiming at simplification and speedup of the process and development of environment-friendly technology, particularly in the fields of clinical photography and reproduction photography. For instance, the clinical image-recording systems or graphic arts block copy materials suitable for laser exposure and heat development have begun to be developed, and the dry systems free of discharge of waste processing solutions have begun to spread.

In those photothermographic light-sensitive materials and heat-sensitive recording materials, the silver source capable of being reduced (e.g., an organic silver salt) and the reducing agent still remain, even after processing. Accordingly, a rise in the minimum density has frequently been observed during the long-term storage after image formation. In order to control the rise in the minimum density upon storage and, in the case of photothermographic light-sensitive materials, the minimum density rise during the heat development also, it is well-known to incorporate mercury compounds, sulfur-containing compounds, halogen-containing compounds or the like in the sensitive materials. Of these compounds, mercury compounds have an advantage of great effect, but also has a disadvantage of hardly avoiding potential danger of environmental pollution. In view of less adverse influence on the natural environment, sulfur-containing compounds and halogen-containing compounds are favorable. However, those compounds are not fully effective in controlling the minimum density rise upon long-term storage although they are on the whole effective for the control of the minimum density rise ascribed to the heat development of photothermographic light-sensitive materials.

SUMMARY OF THE INVENTION

Therefore, an object of the invention is to provide an image recording material, especially a photothermographic light-sensitive image-recording material, which has excellent stability to ensure a reduced rise in the minimum density even at the time the image recording material is stored for a long time after image formation.

The aforesaid object is-attained with image recording materials according to the following embodiments (1) to (4):

(1) An image recording material comprising a support and a constituent layer(s) comprising at least (a) a heat-sensitive imaging layer containing a light-insensitive organic silver salt, a reducing agent of the light-insensitive organic silver salt and a binder or (b) a light-sensitive imaging layer containing a light-sensitive silver halide, light-insensitive organic silver salt, a reducing agent of the light-insensitive organic silver salt and a binder, wherein the image recording material comprises a compound represented by formula (1) in at least one constituent layer:

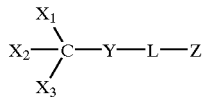

(1)

wherein $X_1$ and $X_2$ each represent a halogen atom; $X_3$ represents a hydrogen atom, a halogen atom or a univalent substituent group; L represents a divalent organic group; Y represents a divalent organic group containing a hetero atom, or a single bond; and Z represents an acidic functional group or a salt thereof.

(2) The image recording material according to item (1), wherein the constituent layer(s) comprises at least (b) a light-sensitive imaging layer.

(3) The image recording material according to item (1), wherein $X_1$ and $X_2$ each represents a bromine atom.

(4) The image recording material according to item (1) wherein $X_3$ represents a bromine atom.

(5) The image recording material according to item (1) wherein Y represents —O—, —CO—, —COO—, —OCO—, —COONR—, —NRCO—, —NRCOONR—, —OCONR—, —NRCOO—, —OCOO—, —S—, —SO—, —$SO_2$— or a phosphorus-containing divalent group, wherein R represents a hydrogen atom, a halogen atom or a univalent substituent group.

(6) The image recording material according to item (1), wherein Y represents —$SO_2$—.

(7) The image recording material according to item (1), wherein L an alkylene group, an arylene group, an alkenylene group, an alkynylene group, a divalent heterocyclic group, a divalent group formed by combining two or more of the above groups, and a divalent group formed by combining any of the above-recited groups with one or more of divalent groups selected from —O—, —CO—, —COO—, —OCO—, —COONR—, —NRCO—, NRCOONR—, —OCONR—, —NRCOO—, —OCOO—, —S—, —SO—, —$SO_2$— and a phosphorus-containing divalent group, wherein R represents a hydrogen atom, a halogen atom, a univalent substituent group.

(8) The image recording material according to item (1), wherein Z represents a carboxyl group or a sulfo group.

(9) The image recording material according to item (1), wherein the compound represented by formula (1-a):

(1-a)

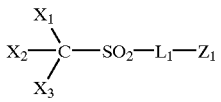

wherein $X_1$, $X_2$ and $X_3$ have the same meanings as in formula (I) respectively, $L_1$ represents a 6–30C arylene group or a 1–30C divalent aromatic heterocyclic group, and $Z_1$ represents a carboxyl group or a sulfo group.

(10) The image recording material according to item (1), wherein the compound is contained of 10 mg/$M^2$ to 10 g/$m^2$.

(11) The image recording material according to item (1), wherein the heat-sensitive imaging layer or the light-sensitive imaging layer was provided by coating and drying a coating composition which contains the binder in the state of aqueous latex or polymer dissolved or dispersed in a water-base solvent.

DETAILED DESCRIPTION OF THE INVENTION

The present image recording material is a heat-sensitive image-recording material comprising a light-insensitive organic silver salt and a compound capable of reducing the organic silver salt (hereinafter referred to as "reducing agent"), or a photothermographic light-sensitive image-recording material comprising a light-sensitive silver halide and a binder, preferably further containing a light-insensitive organic silver salt and a reducing agent. In particular, the photothermographic light-sensitive image-recording material is preferred as the present image recording material. By incorporating a compound represented by formula (1) in any of the constituent layers of such an image recording material, the image recording material can acquire reduction in fog and excellent image storage stability. In contrast, the incorporation of only a halogen-containing compound which differs from the compounds of formula (1) in having neither acidic functional group nor a salt thereof causes deterioration in image storage stability.

For enabling the application using an aqueous solvent from the viewpoint of environment and cost advantages, it is desirable that the binder used in at least one constituent layer, particularly in an image forming layer, be an aqueous latex. The use of an aqueous latex as the binder in an image forming layer is advantageous to the acquisition of excellent photographic properties. In particular, the present compounds represented by formula (1) can achieve favorably their effects in such an aqueous system.

The present compounds represented by formula (1) are illustrated below.

The halogen atom represented by $X_1$ and $X_2$ each in the compound of formula (1) is a chlorine atom, a bromine atom or an iodine atom, preferably a chlorine or bromine atom, particularly preferably a bromine atom.

$X_3$ in the compound of formula (1) represents a hydrogen atom, a halogen atom or a univalent substituent group. The halogen atom represented by $X_3$ is a chlorine atom, a bromine atom or an iodine atom, preferably a chlorine or bromine atom, particularly preferably a bromine atom. Examples of a univalent substituent group represented by $X_3$ include 1–30C (hereinafter e.g., "1–30C" means 1 to 30 carbon atoms) alkyl groups, 6–30C aryl groups, 2–30C alkenyl group, 2–30C alkynyl groups, a nitro group, a cyano group, a hydroxyl group, a carboxyl group or salts thereof, a sulfo group or salts thereof, an amino group, 1–30C alkoxygroups, 6–30C aryloxy groups, 1–30C acyl groups, 1–30C acylamino groups, 1–30C alkylsulfonyl groups, 6–30C arylsulfonyl groups, 1–30C alkylsulfonylamino groups, 6–30C arylsulfonylamino groups, unsubstituted or substituted carbamoyl groups, unsubstituted or substituted sulfamoyl groups and heterocyclic groups. Of these groups, 1–12C alkyl groups, 6–12C aryl groups, 1–30C acyl groups, 1–30C alkylsulfonyl groups, 6–30C arylsulfonyl groups and heterocyclic groups are suitable for the univalent substituent group represented by $X_3$. In particular, 1–8C alkyl groups, 6–8C aryl groups and heterocyclic groups are advantageous over the others. The univalent substituent group represented by $X_3$ may further be substituted. Suitable examples of a substituent the univalent substituent group can have include those recited above as the examples of $X_3$ and halogen atoms. In the compound of formula (1), however, it is most desirable for $X_3$ to be a halogen atom.

Examples of a divalent group represented by L in the compound of formula (1) include 1–30C alkylene groups, 6–30C arylene groups, 2–30C alkenylene groups, 2–30C alkynylene groups, 1–30C divalent heterocyclic groups (including aromatic groups), divalent groups formed by combining two or more of the above groups, and divalent groups formed by combining any of the above-recited groups with one or more of divalent groups selected from —O—, —CO—, —COO—, —OCO—, —COONR—, —NRCO—, —NRCOONR—, —OCONR—, —NRCOO—, —OCOO—, —S—, —SO—, —$SO_2$— and phosphorus-containing divalent groups (wherein R has the same meaning as $X_3$ and, when two or more R groups are present in a molecule, they may be the same or different). Of these groups, 1–30C alkylene groups, 6–30C arylene groups, 2–30C alkenylene groups, 2–30C alkynylene groups, 1–30C divalent heterocyclic groups and divalent groups formed by combining two or more of the above-cited ones are suitable for the divalent group represented by L. In particular, 6–30C arylene groups, 1–30C divalent heterocyclic groups, divalent groups formed by combining two or more thereof and divalent groups formed by combining any of the above-cited ones with a 1–5C alkylene groups are preferred over the others as the divalent group represented by L. The divalent group represented by L may have a substituent group. Suitable examples of such a substituent group include the same groups as recited above with respect to $X_3$ and halogen atoms.

Y in the compound of formula (1) is a hetero atom-containing divalent organic group or a single bond. Examples of a hetero atom-containing divalent organic group represented by Y include—O—, —CO—, —COO—, —OCO—, —COONR—, —NRCO—, —NRCOONR—, —OCONR—, —NRCOO—, —OCOO—, —S—, —SO—, —$SO_2$— and phosphorus-containing divalent groups (wherein R has the same meaning as $X_3$ and, when two R groups are present in a molecule, they may be the same or different). Of these groups, —CO— and —$SO_2$— groups, especially —$SO_2$— group, are preferred over the others as Y.

Z in the compound of formula (1) represents an acidic functional group or a salt thereof. It is desirable for the acidic functional group to be a functional group forming a Brønstead acid, preferably a functional group having a pKa value of 7 or below in water. Suitable examples of an acidic functional group represented by Z include a carboxyl group, a sulfo group and phosphorus-containing acidic functional groups. In particular, carboxyl and sulfo groups are preferable. When Z represents a salt of acidic functional group, the salts suitable for Z include the alkali metal salts (e.g., Na and K salts), alkaline earth metal salts (e.g., Ca, Mg and Ba salts), $NR_4^+$ salts (wherein R has the same meaning as $X_3$ and a plurality of R groups may be the same or different), phosphonium salts and sulfonium salts of the acidic functional groups recited above. When Z represents a $NR_4^+$ salt (wherein R has the same meaning as $X_3$ and a plurality of R groups may be the same or different), phosphonium salt or sulfonium salt of acidic functional group, it is also desirable for the salt to have an inner salt structure.

The compounds preferred in the invention are compounds represented by the following formula (1-a):

(1-a)

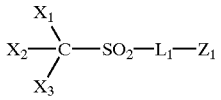

wherein $X_1$, $X_2$ and $X_3$ have the same meanings as in formula (I) respectively, $L_1$ represents a 6–30C arylene group or a 1–30C divalent aromatic heterocyclic group, and $Z_1$ represents a carboxyl group or a sulfo group. Preferably, $L_1$ is a 6–30C arylene group, especially a phenylene group, and $Z_1$ is a carboxyl group.

The compounds represented by formula (1) may be used alone or as combination of two or more thereof. Into an image recording material according to the invention, the present compounds may be incorporated as a solution in water or an organic solvent such as methanol, or in a dispersed state of fine solid particles, or in a state of emulsified dispersion as often employed for photographic materials. The location in which the present compounds are incorporated may be any of the constituent layers of the image recording material, including a light-sensitive layer, a light-insensitive layer, an image recording layer, a protective layer or so on. Additionally, the present compounds may be incorporated in two or more of the constituent layers. The appropriate amount of the present compounds per $m^2$ of image forming material is from 10 $mg/m^2$ to 10 $g/m^2$, preferably from 50 $mg/m^2$ to 2 $g/m^2$.

The representatives of the present compounds of formula (1) are illustrated below, but it should be understood that these examples are not to be construed as limiting the scope of the invention.

1-1

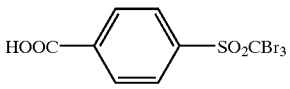

1-2

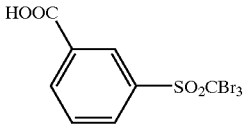

-continued 1-3

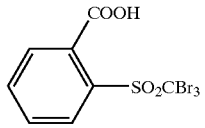

1-4

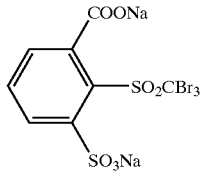

1-5

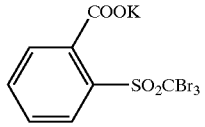

1-6

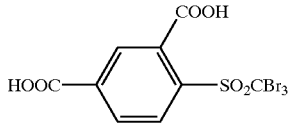

1-7

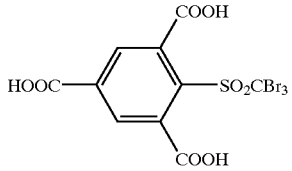

1-8

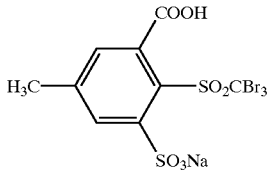

1-9

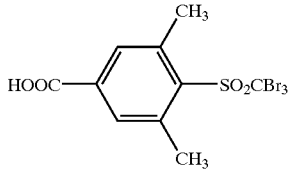

1-10

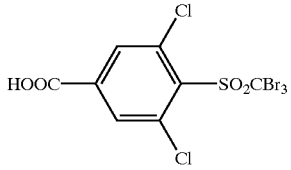

1-11

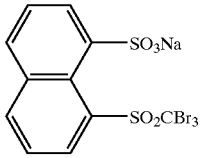

-continued
1-12
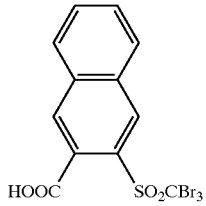
1-13
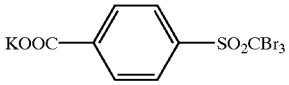
1-14
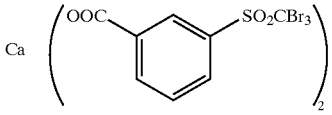
1-15
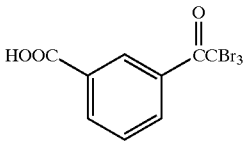
1-16
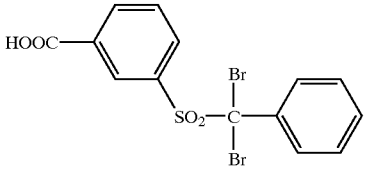
1-17
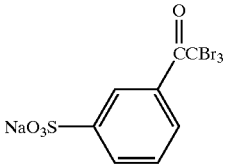
1-18
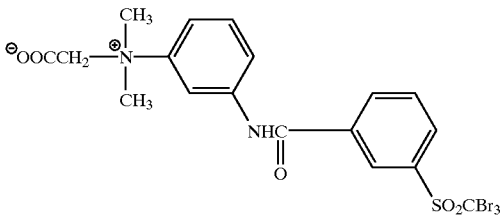
2-1
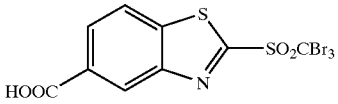
2-2
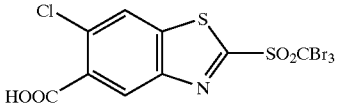
2-3
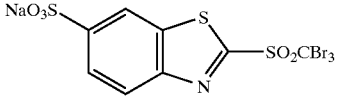
-continued
2-4
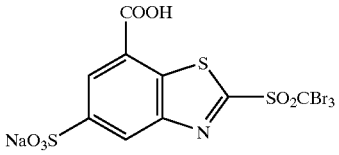
3-1
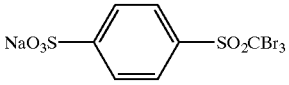
3-2
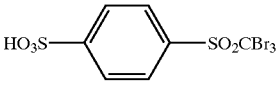
3-3
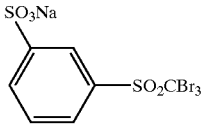
3-4
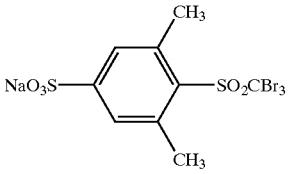
3-5
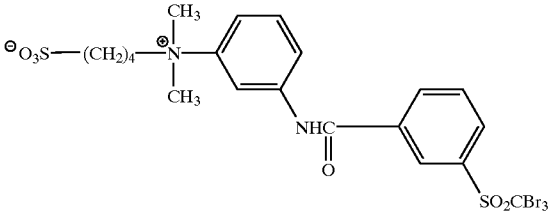
4-1
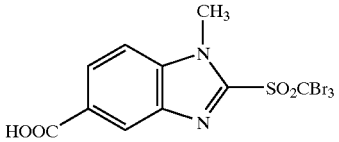
4-2
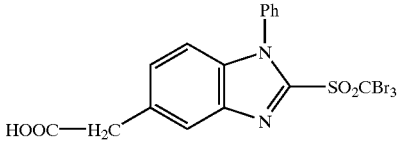
4-3
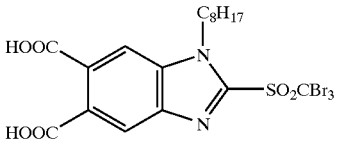
4-4
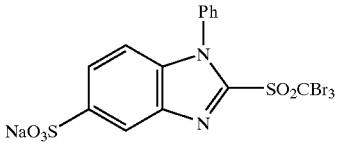

-continued 5-1

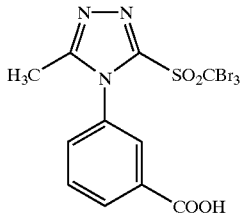

5-2

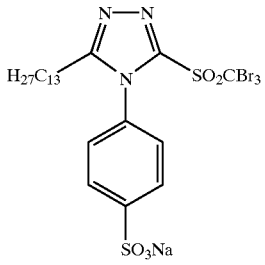

5-3

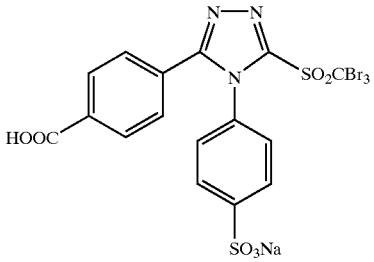

5-4

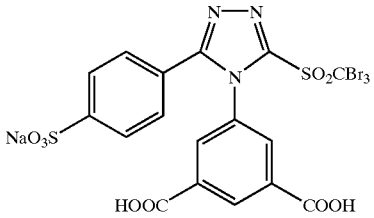

6-1

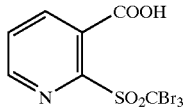

6-2

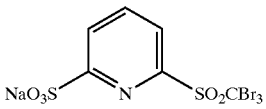

6-3

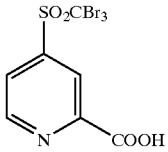

6-4

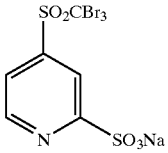

-continued 7-1

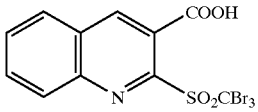

7-2

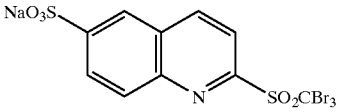

7-3

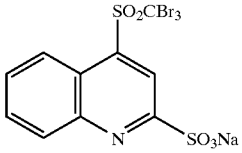

7-4

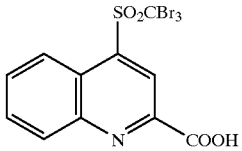

8-1

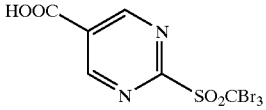

8-2

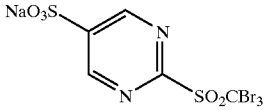

8-3

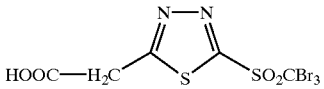

8-4

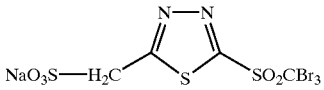

8-5

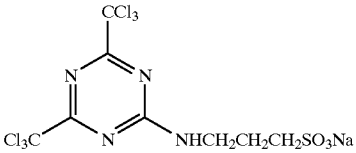

Although those compounds can be synthesized according to known organic synthesis reactions, synthesis examples of the representative thereof are described below.

SYNTHESIS EXAMPLE 1

Synthesis of Compound 1-3

Sodium hydroxide in an amount of 316.5 g was dissolved in 970 ml of water, and thereinto 204 ml of bromine was dripped over a period of 90 minutes as the interior temperature was kept around 4° C. After the dripping was completed, the resulting solution was stirred for 30 minutes in an ice bath, and thereto 100 g of Compound (A) powder was added over a period of 30 minutes. After the addition, the reaction was conducted in the resulting mixture by keeping the interior temperature at 50° C. for 1 hour. Thereafter, the reaction mixture was cooled in an ice bath to precipitate crystals. These crystals were filtered off, and dissolved in water. This water solution was subjected to acid precipitation using a 12N water solution of HCl to deposite crystals. The crystals thus deposited were filtered off.

The filtered matter was dissolved in a water solution of sodium acetate as heat was applied thereto, and subjected to acid precipitation using a 12N water solution of HCl. The crystals thus deposited were filtered off. The filtered matter underwent those operations for purification for two times to give 110 g of Compound 1–3 (in a 53.4% yield).

Compound (A)

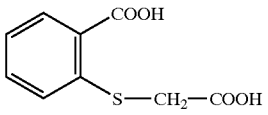

SYNTHESIS EXAMPLE 2

Synthesis of Compound 3-1

Sodium hydroxide in an amount of 114.2 g was dissolved in 350 ml of water, and thereinto 73.5 ml of bromine was dripped over a period of 60 minutes as the interior temperature was kept around 8° C. After the dripping was completed, the resulting solution was stirred for 1 hour in an ice bath, and thereto a solution of 50 g of Compound (B) in 200 ml of water was added dropwise over a period of 40 minutes. After the addition, the reaction was conducted in the resulting mixture by keeping the interior temperature at 55° C. for 90 minutes. Thereafter, the reaction mixture was cooled in an ice bath. The crystals thus deposited were filtered off, and the filtered matter was recrystallized from 1 liter of water to give 32 g of Compound 3-1 (in a 38.0% yield).

Compound (B)

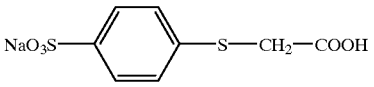

The light-insensitive organic silver salts usable in the invention are silver salts which are relatively stable to light, but form silver image when they are heated up to 80° C. or above in the presence of exposed photo-catalyst (e.g., latent image formed from light-sensitive silver halide) and a reducing agent. Such organic silver salts may be any of organic substances as far as they each contain a source capable of reducing silver ion. Specifically, silver salts of organic acids, especially silver salts of long-chain (10–30C, preferably 15–28C) aliphatic carboxylic acids, are preferred as organic silver salts. In addition, organic or inorganic silver complex salts the ligands of which have a complexation stability constant ranging from 4.0 to 10.0 are also used to advantage. Preferably, such a silver providing substance can comprise about 5–70 weight % of an image forming layer. The organic silver salts used favorably in the invention include the silver salts of carboxyl group-containing organic compounds. Examples thereof include the silver salts of aliphatic carboxylic acids and those of aromatic carboxylic acids, but these examples should not be construed as limiting the scope of the invention. Suitable examples of a silver salt of aliphatic carboxylic acid include silver behenate, silver arachidate, silver stearate, silver oleate, silver laurate, silver caproate, silver myristate, silver palmitate, silver maleate, silver fumarate, silver tartarate, silver linolate, silver butyrate, silver camphorate and mixtures of two or more of the above-recited salts.

The silver salts of organic acids which can be favorably used in the invention are prepared by reacting silver nitrate with solutions or suspensions of alkali metal salts (e.g., Na, K and Li salts) of organic acids as recited above. The alkali metal salts of organic acids can be obtained by treating the foregoing organic acids with alkali. The preparation of the present silver salts of organic acids can be performed in an arbitrary reaction vessel in accordance with a batch or continuous process. The appropriate way of stirring in the reaction vessel can be chosen depending on the intended grain characteristics. The method adopted for the preparation of a silver salt of organic acid can be any of the method of adding gradually or rapidly a water solution of silver nitrate to the reaction vessel in which a solution or suspension of alkali metal salt of organic acid is placed, the method of adding gradually or rapidly a previously prepared solution or suspension of alkali metal salt of organic acid to the reaction vessel in which a water solution of silver nitrate is placed, and the method of preparing in advance a water solution of silver nitrate and a solution or suspension of alkali metal salt of organic acid and simultaneously adding them to the reaction vessel.

For the purpose of controlling the grain size of the silver salt of organic acid upon the preparation thereof, the concentrations of a water solution of silver nitrate and a solution or suspension of alkali metal salt of organic acid and the addition speeds thereof can be chosen variously. As for the method of adding a water solution of silver nitrate and a solution or suspension of alkali metal salt of organic acid, one can adopt not only the method of adding at a constant speed but also the accelerative or decelerative addition method according to an arbitrary temporal function. Additionally, one reactant solution may be added to either the surface or the inside of the other reactant solution. In the case of simultaneous addition of a water solution of silver nitrate and a solution or suspension of alkali metal salt of organic acid to a reaction vessel, one solution can have a start over the other solution of a certain period in the addition operation. Preferably, the water solution of silver nitrate precedes the other solution in addition. The suitable degree of precedence is from 0 to 50 volume %, especially from 0 to 25 volume %, of the total addition amount. Further, as disclosed in JP-A-9-127643 (the term "JP-A" as used herein means an "unexamined published Japanese patent application"), the method of adding reactant solutions while controlling the pH or silver potential of the reaction system can be employed to advantage.

In adding a water solution of silver nitrate and a solution or suspension of alkali metal salt of organic acid, the pH values thereof can be adjusted depending on-the grain characteristics required. The pH adjustment can be effected by addition of arbitrarily chosen acids or alkalis. Further, the temperature inside the reaction vessel can be chosen properly depending on the characteristics required for the grains prepared, e.g., for the control of grain size of the silver salt prepared. On the other hand, the temperatures of solutions to be added can be adjusted arbitrarily. In order to secure the flowability, however, it is desirable that the solution or suspension of an alkali metal salt of organic acid be heated up to at least 50° C. and kept warm.

In the invention, it is desirable that the silver salt of organic acid be prepared in the presence of a tertiary alcohol. For the tertiary alcohol used therein, it is desirable to contain at most 15 carbon atoms in all, especially at most 10 carbon atoms in all. An example of a desirable tertiary alcohol is tert-butanol, but this example should not be construed as limiting the scope of the invention.

Such a tertiary alcohol may be added at any stage in preparation of the silver salt of an organic acid. However, it is advantageous that the tertiary alcohol be added at the time the alkali metal salt of organic acid is prepared and the alkali metal salt prepared be dissolved therein. The suitable proportion of the tertiary alcohol used to the water used as solvent in the preparation of the silver salt of organic acid is from 1/100 to 10/1 by weight, preferably from 3/100 to 1/1 by weight.

The silver salts of mercapto or thione group-containing compounds and derivatives thereof can also be employed. Suitable examples of such compounds include the silver salt of 3-mercapto-4-phenyl-1,2,4-triazole, the silver salt of 2-mercaptobenzimidazole, the silver salt of 2-mercapto-5-amino-thiadiazole, the silver salt of 2-(ethylglycolamido)-benzothiazole, the silver salts of thioglycolic acids such as S-alkylthioglycolic acids (the alkyl moiety of which contains 12–22 carbon atoms), the silver salts of dithiocarboxylic acids such as dithioacetic acid, the silver salts of thioamides, the silver salt of 5-carboxyl-1-methyl-2-phenyl-4-thiopyridine, the silver salt of mercaptotriazine, the silver salt of 2-mercaptobenzoxazole, the silver salts disclosed in U.S. Pat. No. 4,123,274 (e.g., the silver salts of 1,2,4-mercaptothiazole derivatives such as 3-amino-5-benzylthio-1,2,4-thiazole), and the silver salts of thione compounds disclosed in U.S. Pat. No. 3,301,678 (e.g., the silver salt of 3-(3-carboxyethyl)-4-methyl-4-thiazoline-2-thione). In addition, the imino group-containing compounds can also be employed. Suitable examples of such compounds include the silver salts of benzotriazoles and derivatives thereof (e.g., the silver salts of benzotriazoles such as mentylbenzotriazole silver, the silver salts of halogen-substituted benzotriazoles such as 5-chlorobenzotriazole silver, the silver salts of 1,2,4-triazoles and 1-H-tetrazoles as disclosed in U.S. Pat. No. 4,220,709, and the silver salts of imidazole and its derivatives. Further, the various silver acetylide compounds as disclosed in U.S. Pat. Nos. 4,761,361 and 4,775,613 can be used, too.

The organic silver salts usable in the invention have no particular restriction as to their shape, but it is desirable for them to be scale-shape crystals or needle-shape crystals having minor and major axes. Preferably, the minor axis is from 0.01 $\mu$m to 0.20 $\mu$m, particularly from 0.01 $\mu$m to 0.15 $\mu$m, and the major axis is preferably from 0.10 $\mu$m to 5.0 $\mu$m, particularly from 0.10 $\mu$m to 4.0 $\mu$m. It is desirable for the organic silver salt grains to have a monodisperse size distribution. The term "monodisperse" used herein means that both the values obtained by dividing the standard deviation values of the grain size distribution concerning minor and major axes by the average minor axis length and the average major axis length respectively are at most 100%, preferably at most 80%, more preferably at most 50%, expressed in percentage. The organic silver salt's shape can be examined by observation of an organic silver salt dispersion under a transmission electron microscope. Another method of determining the monodisperse degree comprises determining the standard deviation with respect to the volume weighted average diameter of organic silver salt grains. The percentage of the value obtained by dividing the standard deviation determined above by the volume weighted average diameter (variation coefficient) is preferably 100% or below, more preferably 80% or below, and particularly preferably 50% or below. This variation coefficient can be determined by, e.g., exposing an organic silver salt dispersed in liquid to laser beams, determining the auto correlation function of fluctuations of scattered light with the passage of time, and therefrom calculating the grain sizes (volume weighted average diameter).

The organic silver salts usable in the invention can undergo a desalting operation. The desalting operation can be carried out using any conventional method. For instance, known filtration methods, including centrifugal filtration, suction filtration, ultrafiltration and aggregation method which comprises floc formation washing, can be employed favorably.

In order to prepare a dispersion of non-aggregated solid organic silver salt having a high S/N ratio and a small grain size, it is desirable to adopt a dispersion method which comprises converting an aqueous dispersion containing an organic silver salt as image forming medium but substantially no light-sensitive silver salt into a high-speed flow and then causing a drop in pressure.

After those steps, the resulting dispersion is mixed with an aqueous solution of light-sensitive silver salt to prepare a coating solution containing a light-sensitive image forming medium. The use of this coating solution in the production of a photothermographic light-sensitive material can ensure slight haze, low fog and high sensitivity in the photosensitive material produced. In contrast, if the dispersion is converted into a high-pressure and high-speed flow in the presence of a light-sensitive silver salt, a rise in fog and a serious drop in sensitivity are liable to be caused in the photosensitive material produced. And if the dispersion medium used is not water but an organic solvent, the photosensitive material produced tends to suffer from a rise in haze and fog and a drop in sensitivity. On the other hand, the use of a conversion method, wherein a part of organic silver salt in the dispersion is converted to light-sensitive silver salt, instead of the method of mixing the dispersion with an aqueous solution of light-sensitive silver salt tends to cause a drop in sensitivity.

The foregoing aqueous dispersion prepared through the conversion into a high-pressure and high-speed flow contains substantially no light-sensitive silver salt. The allowable proportion of light-sensitive silver salt is at most 0.1 mole % to the light-insensitive. organic silver salt, so the positive addition of a light-sensitive silver salt is not carried out.

Details of the devices and the arts of solid dispersion usable for carrying out the aforementioned dispersion method are described in, e.g., Toshio Kajiuchi & Hiromoto Usui *Rheology of Dispersion System and Dispersing Techniques*, pp. 357–403, Shinzansha Shuppan (1991), and *Progress of Chemical Engineering*, the 24th series, pp. 184–185, compiled by Corporation Chemical Engineering Society, Tokai Branch, published by Maki Shoten in 1990. More specifically, the finely dispersing method adopted in the invention comprises applying pressure to an aqueous dispersion containing at least an organic silver salt by means of a high-pressure pump, sending the dispersion out into a pipe and then making it pass through narrow slits provided inside the pipe, and further causing a sharp pressure drop in the dispersion.

The high-pressure homogenizer relating to the invention is generally thought to enable the preparation of a fine-grain dispersion by its dispersing power, including (a) "shearing stress" generated upon passage of a dispersoid through narrow slits at a high speed under high pressure and (b) "cavitation power" created upon the release of the dispersoid from a highly pressed condition into ordinary condition. As for the dispersing devices of the foregoing type, there has been known Gaulin Homogenizer from the old. In such a device, the composition to undergo dispersion is sent out under a high pressure and converted into a high-speed flow upon passage through the slits on the cylindrical face. The flow gushed out of the slits collides with the surrounding wall and the impact of the collision emulsifies and disperses the composition. The pressure applied is generally from 100 to 600 kg/cm$^2$, and the flow rate is from several to 30 meters per second. For the purpose of heightening the dispersing efficiency, a device has been designed so as to increase the number of times the flow collides with the wall, e.g., by giving a saw-toothed shape to the high flow rate section. Further, the devices enabling the dispersion at a higher flow rate under higher pressure have been developed in recent years. The representatives of such devices are Microfluidizer (made by Microfluidex International Corporation) and Nanomizer (made by Tokushu Kika Kogyo Co., Ltd.).

Examples of a dispersing device favorably used in the invention include MicrofluidizersM-110S-EH (equipped with an interaction chamber G10Z), M-110Y (equipped with an interaction chamber H10Z), M-140K (equipped with an interaction chamber G10Z), HC-5000 (equipped with an interaction chamber L30Z or H230Z) and HC-8000 (quipped with an interaction chamber E230Z or L30Z), made by Microfluidex International Corporation.

By using the device as recited above, an aqueous dispersion containing at least organic silver salt is sent out into a pipe as pressure is applied thereto by means of a high-pressure pump or the like, and further the intended pressure is applied to the dispersion by making it pass through narrow slits provided inside the pipe, and then a sharp pressure drop is caused in the dispersion by rapidly returning the pressure inside the pipe to atmospheric pressure. As a result, the organic silver salt dispersion most suitable for the invention can be obtained.

In prior to the foregoing dispersion operation, it is desirable that the composition as a raw material be subjected to pre-dispersion. As for the means to carry out the pre-dispersion, one can employ known dispersing means, e.g., a high-speed mixer, a homogenizer, a high-speed impact mill, a Banbury mixer, a homomixer, a kneader, a ball mill, a vibrating ball mill, a planetary ball mill, an attriter, a sand mill, a beads mill, a colloidal mill, a jet mill, a roller mill, a tron mill and a high-speed stone mill. In addition to the mechanical dispersion, the dispersoid may be dispersed coarsely in a solvent by the pH control and then finely dispersed by changing the pH in the presence of a dispersing aid. The solvent used for the coarse dispersion may be an organic solvent, but it is generally removed at the conclusion of the fine dispersion.

In the present dispersion of an organic silver salt, it is possible to disperse the salt in the intended grain size by controlling the flow rate, the pressure gap at the time of pressure drop and the number of times the dispersing operation is repeated. Specifically, the suitable flow rate-is in the range of 200 m/sec to 600 m/sec, especially 300 m/sec to 600 m/sec, and the suitable pressure gap at the time of pressure drop is in the range of 900 kg/cm$^2$ to 3,000 kg/cm$^2$, especially 1,500 kg/cm$^2$ to 3,000 kg/cm$^2$. The suitable number of times the dispersing operation is repeated, though depends on the intended purpose, is generally from 1 to 10, and of the order of 1–3 from the productivity point of view. Under the high pressure as mentioned above, it is undesirable to leave the aqueous dispersion in a high-temperature condition from the viewpoints of dispersibility and photographic properties. If the aqueous dispersion is kept at a temperature higher than 90° C., the size of grains tends to increase, and there is a tendency to heighten the fog density. Therefore, it is desirable that the cooling step be inserted in the process before the conversion to a high-speed flow under high pressure or/and in the process after the pressure drop, and thereby the temperature of the aqueous dispersion be kept within the range of 5 to 90° C., preferably 5 to 80° C., particularly preferably 5 to 65° C. In particular, it is effective to have the foregoing cooling step when the dispersing operation is carried out under the high pressure ranging from 1,500 to 3,000 kg/cm$^2$. The condenser used in such a cooling step can be chosen from a double-tube condenser, the combination of a double-tube condenser with a static mixer, a shell and tube heat exchanger or a coiled heat exchanger, depending on the quantity of heat to be exchanged. After considering the pressure under which the condenser is used, the diameter, thickness and material of the condenser tube are chosen so that they are adequate to enhance the efficiency of heat exchange. The refrigerant used in the condenser may be 20° C. well water or 5–10° C. water processed with a refrigerator, depending on the quantity of heat to be exchanged. Further, such a refrigerant as −30° C. ethylene glycol/water can be employed, if needed.

In the present dispersing operation, it is desirable that the organic silver salt be dispersed in the presence of a disparsant (dispersing aid) soluble in aqueous solvent. Examples of a dispersing aid usable therein include synthetic anionic polymers, such as polyacrylic acid, acrylic acid copolymers, maleic acid copolymers, maleic acid monoester copolymers and acrylomethylpropanesulfonic acid copolymers; semi-synthetic anionic polymers, such as carboxymethyl starch and carboxymethyl cellulose; anionic polymers such as alginic acid and pectic acid; the compounds disclosed in JP-A-7-350753; known anionic, nonionic and cationic surfactants; known polymers such as polyvinyl alcohol, polyvinyl pyrrolidone, hydroxypropyl cellulose and hydroxypropylmethyl cellulose; and natural macromolecular compounds such as gelatin. Of these compounds, polyvinyl alcohol and water-soluble cellulose derivatives are preferred over the others.

In general, the dispersing aid may be mixed with an organic silver salt powder or wet cake prior to the dispersing operation, made into slurry, and then send out into a dispersing device. On the other hand, it's all right to treat the mixture of an organic silver salt with the dispersing aid with heat or a solvent, and then to make the mixture into a powder or wet cake. Before, after or during the dispersion, the pH control may be carried out by the use of an appropriate pH modifier.

Besides the mechanical dispersion, it is also possible to carry out coarse dispersion in a solvent by controlling the pH and then fine dispersion by changing the pH in the presence of a dispersing aid. The solvent used for the coarse dispersion may be an organic solvent, but it is generally removed at the conclusion of the fine dispersion.

For the purpose of inhibiting the sedimentation of fine grains, the dispersion prepared can be kept with stirring or in a state that the viscosity thereof is increased by the addition of hydrophilic colloid. Further, preservatives may be added to the dispersion for the purpose of preventing bacteria of various sorts from propagating upon storage.

The size of solid fine grains in the present organic silver salt dispersion can be determined, e.g., as the grain size (volume weighted average diameter) calculated from the auto correlation function of scattered light fluctuations with the passage of time, which can be determined by exposing the solid fine grains dispersed in liquid to laser beams. It is desirable for the dispersion of solid fine grains to have an average grain size in the range of 0.05 to 10.0 μm, preferably 0.1 to 5.0 μm, particularly preferably 0.1 to 2.0 μm.

The grain size distribution of organic silver salt is preferably monodisperse. Specifically, the percentage of the value obtained by dividing the standard deviation concerning the volume weighted average diameter by the volume weighted average diameter (variation coefficient) is preferably 80% or below, more preferably 50% or below, and particularly preferably 30% or below.

The organic silver salt's shape can be examined by observation of an organic silver salt dispersion under a transmission electron microscope.

The present dispersion of solid fine grains of organic silver salt comprises at least an organic silver salt and water. The proportion of the organic silver salt to the water has no particular limitation, but the proportion of the organic silver salts to the whole dispersion is preferably from 5 to 50 weight %, particularly preferably from 10 to 30 weight %. Although it is effective to use a dispersing aid as mentioned above, the proportion of dispersion aid used is desirably reduced to the minimum as far as the minimum grain size can be attained. Preferably, the proportion thereof to the organic silver salt is from 1 to 30 weight %, especially from 3 to 15 weight %.

The present photosensitive material can be produced using a mixture of an aqueous organic silver salt dispersion with an aqueous light-sensitive silver salt dispersion. The ratio of an organic silver salt to a light-sensitive silver salt in the mixture can be selected depending on the intended purpose. Specifically, it is desirable that the proportion of the light-sensitive silver salt to the organic silver salt be from 1 to 30 mole %, preferably from 3 to 20 mole %, particularly from 5 to 15 mole %. In preparing the foregoing mixture, two or more kinds of aqueous organic silver salt dispersions can be mixed with two or more kinds of aqueous light-sensitive silver salt dispersions. This way of mixing is advantageous for the control of photographic characteristics.

The present organic silver salt can be used in the desired amount. However, the amount thereof is preferably 0.1–5 $g/m^2$, and more preferably 1–3 $g/m^2$, reduced to the amount (gram) of silver per $m^2$ of image recording material (hereinafter referred to as "silver coverage").

The light-sensitive silver halide used in the invention has no particularly restriction as to the halide composition, but it can be silver chloride, silver chlorobromide, silver bromide, silver iodobromide or silver iodochlorobromide. The halide composition inside the grains may have a uniform distribution, or a stepwise or continuously changing distribution. Further, the silver halide grains having a core/shell structure can be used to advantage. The suitable core/shell grains are those having a double to quintuple structure, especially a double to quadruple structure. Furthermore, the arts of localizing silver bromide on the grain surface of silver chloride or silver chlorobromide can be favorably adopted.

The methods for forming light-sensitive silver halide are well known to persons skilled in the art. For instance, the methods disclosed in *Research Disclosure* No. 17029 (June, 1978) and U.S. Pat. No. 3,700,458 can be adopted. Specifically, a silver providing compound and a halogen providing compound are added to a solution of gelatin or another polymer to prepare a light-sensitive silver halide. Then, the light-sensitive silver halide prepared is mixed with an organic silver halide. For the purpose of preventing a milky turbidity from appearing after image formation, it is desirable for the light-sensitive silver halide to have a small grain size, specifically 0.20 μm or below, preferably from 0.01 μm to 0.15 μm, more preferably from 0.02 μm to 0.12 μm. The term "grain size" used herein refers to the edge length when the grains have a regular crystal form, such as a cube or octahedron, or the diameter of a circle having the same area as the projected area of the major surface when the grains have a tabular form. In cases where the grains have an irregular crystal form, such as a ball or rod, the term grain size means the diameter of a sphere which is considered to have the equivalent volume with each grain.

Examples of a shape the silver halide grains can have include cubic, octahedral, tabular, spherical, rod-like and potato-like shapes. In the invention, cubic grains and tabular grains are preferred over the others. The average aspect ratio of tabular silver halide grains preferably used in the invention is from 100:1 to 2:1, especially from 50:1 to 3:1. In addition, it is also desirable to use silver halide grains having round corners. The outer surface of silver halide grains has no particular restriction as to the index of a plane (Miller indices). In a case where the spectral sensitizing dyes are adsorbed to silver halide grains, however, it is desirable that the (100) surface constitute a large proportion of the outer surface, because the spectral sensitizing dyes on the (100) surface can achieve high spectral sensitization efficiency. The suitable proportion of the (100) surface is at least 50%, preferably at least 65%, more preferably at least 80%. The proportion of (100) surface, can be determined using the method described in T. Tani *J. Imaging Sci.*, 29, 165 (1985), wherein the Miller indices dependence of the sensitizing dye adsorption to silver halide grains, specifically difference between (111) and (100) surfaces in the adsorption, is utilized.

The light-sensitive silver halide grains used in the invention contain a VII or VIII group metal or metal complex. Suitable example of a VII or VIII group metal or the central atom of a VII or VIII group metal complex include rhodium, rhenium, ruthenium, osmium and iridium. These metal complexes may be used alone or as a combination of two or more different complexes containing the same metal or different metals. The suitable content of such a metal or metal complex is from $1\times10^{-9}$ mole to $1\times10^{-3}$ mole, preferably from $1\times10^{-8}$ mole to $1\times10^{-4}$ mole, per mole of silver. Specifically, the complexes having the structure as disclosed in JP-A-7-225449 can be used advantage.

The rhodium compounds usable in the invention are water-soluble rhodium compounds, with examples including rhodium(III) halides and rhodium complexes having halogen, amine or oxalato ligands, such as hexachlororhodium(III) complex, pentachloroaquorhodium (III) complex, tetrachlorodiaquorhodium(III) complex, hexabromorhodium(III) complex, hexaamminerhodium(III) complex, trioxalatorhodium(III) complex. In using these rhodium compounds, they are dissolved in water or another appropriate solvent. The method generally used for stabilizing a solution of rhodium compound, namely the addition of an aqueous solution of hydrogen halide (e.g., hydrochloric acid, hydrobromic acid, hydrofluoric acid) or an alkali halide (e.g., KCl, NaCl, KBr, NaBr), can be employed. Instead of using a water-soluble rhodium compound, another silver halide grains previously doped with rhodium can be added and dissolved during the preparation of the intended silver halide.

It is desirable that the rhodium compounds as recited above be added in an amount of $1\times10^{-8}$ mole to $5\times10^{-6}$ mole, particularly preferably $5\times10^{-8}$ mole to $1\times10^{-6}$ mole.

Those rhodium compounds can be added during the preparation of silver halide emulsion grains or at any stage before the emulsion is coated. However, it is particularly advantageous that they be added during the emulsion-making to be incorporated in the silver halide.

Rhenium, ruthenium and osmium are added as the water-soluble complexes disclosed, e.g., in JP-A-63-2042, JP-A-1-285941, JP-A-2-20852 and JP-A-2-2-855. Especially favorable complexes are six-coordinate complexes represented by the following formula;

$$[ML_6]^{n-}$$

wherein M is Ru, Re or Os, L is a ligand, and n is 0, 1, 2, 3 or 4.

In this case, the counter ion lacks importance, so it may be ammonium ion or an alkali metal ion.

Suitable examples of a ligand include halide, cyanide, cyanate, nitosyl and thionitrosyl ligands. Examples of complexes usable in the invention are illustrated below, but these examples should not be construed as limiting the scope of the invention:

$[ReCl_6]^{3-}$, $[ReBr_6]^{3-}$, $[ReCl_5(NO)]^{2-}$, $[Re(NS)Br_5]^{2-}$, $[Re(NO)(CN)_5]^{2-}$, $[Re(O)_2(CN)_4]^{3-}$;

$[RuCl_6]^{3-}$, $[RuCl_4(H_2O)_2]^{-}$, $[RuCl_5(H_2O)]^{2-}$, $[RuCl_5(NO)]^{2-}$, $[RuBr_5(NS)]^{2-}$, $[Ru(CO)_3Cl_3]^{2-}$, $[Ru(CO)Cl_5]^{2-}$, $[Ru(CO)Br_5]^{2-}$;

$[OsCl_5(NO)]^{2-}$, $[Os(NO)(CN)_5]^{2-}$, $[Os(NS)Br_5]^{2-}$, $[Os(O)_2(CN)_4]^{4-}$.

The amount of these compounds added is preferably from $1\times10^{-9}$ to $1\times10^{-5}$ mole, preferably from $1\times10^{-8}$ to $1\times10^{-6}$ mole, per mole of silver halide.

Those compounds can be added during the preparation of silver halide emulsion grains or at any stage before the emulsion is coated. In particular, it is favorable to add them during the emulsion-making and thereby incorporate them in silver halide grains.

In order to incorporate those compounds into silver halide grains by the addition during the formation of silver halide grains, one can adopt the method of adding in advance metal complex powder or a solution prepared by dissolving metal complexes in water together with NaCl or KCl to a water-soluble silver salt or halide solution for forming grains, the triple jet method wherein a metal complex solution is added as the third solution at the time the silver salt and halide solutions are admixed at the same time, or the method of pouring a necessary amount of aqueous metal complex solution into the reaction vessel during the formation of grains. In particular, it is advantageous to adopt the method of adding metal complex powder or a solution prepared by dissolving metal complexes in water together with NaCl or KCl to a water-soluble halide solution.

In order to add the foregoing compounds to the grain surface, it is also possible to pour a necessary amount of aqueous metal complex solution into the reaction vessel immediately after the grain formation, in the course or at the conclusion of physical ripening, or at the time of chemical ripening.

The iridium compounds usable in the invention include various compounds, such as hexachloroiridium, hexaammineiridium, trioxalatoiridium, hexacyanoiridium and pentachloronitrosylidiridum. In using these iridium compounds, they are dissolved in water or another appropriate solvent. The method generally used for stabilizing a solution of iridium compound, namely the addition of an aqueous solution of hydrogen halide (e.g., hydrochloric acid, hydrobromic acid, hydrofluoric acid) or an alkali halide (e.g., KCl , NaCl, KBr, NaBr), can be employed. Instead of using a water-soluble iridium compound, another silver halide grains previously doped with iridium can be added and dissolved during the preparation of the intended silver halide.

The silver halide grains used in the invention can further contain metal atoms, such as cobalt, iron, nickel, chromium, palladium, platinum, gold, thallium, copper and lead. As for the compounds of cobalt, iron, chromium and ruthenium, hexacyano-metal complexes are used to advantage. Examples thereof include ferricyanate ion, ferrocyanate ion, hexacyanocobaltate ion, hexacyanochromate ion, and hexacyanoruthenate ion, but these examples should not be construed as limiting the scope of the invention. As for the distribution of these metal complexes inside the silver halide grains, there is no particular restriction. In other words, they may be incorporated uniformly throughout the grains, or in a high concentration in the core or the shell part.

It is desirable for the foregoing metals to be added in an amount of $1\times10^{-9}$ to $1\times10^{-4}$ mole per mole of silver halide. Such metals can be incorporated in silver halide grains by adding them as metal salts, namely single, double or complex salts, at the time the grains are formed.

The light-sensitive silver halide grains can be desalted using a well-known washing method, e.g., a noodle washing method or a flocculation method. However, the grains may or may not undergo desalting treatment in the invention.

The gold sensitizer used in the gold sensitization of the present silver halide emulsions has an oxidation number of +1 or +3, and may be any of gold compounds generally used as gold sensitizer. Typical examples of such a compound include potassium chloroaurate, auric trichloride, potassium aurothiocyanate, potassium iodoaurate, tetracyanoauric acid, ammonium aurothiocyanate, and pyridyltrichlorogold.

The suitable amount of gold sensitizer added depends on the conditions adopted. As a general standard, the amount added is from 11×0–7 to $1\times10^{-3}$ mole per mole of silver halide. Preferably, it is from $1\times10^{-6}$ to $5\times10^{-4}$ mole per mole of silver halide.

In chemically sensitizing the present silver halide emulsions, it is desirable to carry out gold sensitization in combination with another chemical sensitization. Any of known methods, such as a sulfur sensitization method, a selenium sensitization method, a tellurium sensitization method and a precious metal sensitization method, can be adopted -as another chemical sensitization method. Suitable examples of such a combination include the combination of sulfur and gold sensitization methods, that of selenium and gold sensitization methods, that of sulfur, selenium and gold sensitization methods, that of sulfur, tellurium and gold sensitization methods, and that of sulfur, selenium, tellurium and gold sensitization methods.

The sulfur sensitization method used to advantage in the invention generally comprises adding a sulfur sensitizer to an emulsion and stirring the emulsion for a prescribed time at a high temperature of 40° C. or above. Any of the compounds known as sulfur sensitizer can be used therein. For instance, not only the sulfur compounds contained in gelatin, but also various sulfur compounds, including thiosulfates, thioureas, thiazoles and rhodanines, can be employed. Of those compounds, thiosulfates and thiourea compounds are preferred over the others. The suitable amount of sulfur sensitizer added, though depends on the pH and temperature during the chemical ripening, the grain size of silver halide and other various conditions, is from $1\times10^{-7}$ to $1\times10^{-2}$ mole, preferably from $1\times10^{-5}$ to $1\times10^{-3}$ mole, per mole of silver halide.

The selenium sensitizers usable in the invention include known selenium compounds. Specifically, selenium sensitization can be effected by adding an unstable and/or non-unstable selenium compound to an emulsion and stirring the emulsion for a prescribed time at a high temperature of 40° C. or above. Examples of an unstable selenium compound which can be used include the compounds disclosed in, e.g., JP-A-44-15748, JP-A-43-13489, JP-A-4-25832, JP-A-4-109240 and JP-A-4-324855. In particular, the compounds represented by formulae (VIII) and (IX) in JP-A-4-324855 are preferred over the others.

The tellurium sensitizers usable in the invention are compounds producing silver telluride presumed to form sensitization nuclei at the surface of or inside the silver halide grains. The production rate of silver telluride in a silver halide emulsion can be examined by the method disclosed in JP-A-5-313284. Examples of such a tellurium sensitizer include diacyl tellurides, bis(oxycarbonyl) tellurides, bis(carbamoyl)tellurides, diacyl ditellurides, bis (oxycarbonyl)ditellurides, bis(carbamoyl)ditellurides, compounds having a P=Te bond, tellurocarboxylic acid salts, Teorganotellurocarboxylic acid esters, di(poly)tellurides, tellurides, tellurols, telluroacetals, tellurosulfonates, compounds having a P—Te bond, Te-containing hetero rings, tellurocarbonyl compounds, inorganic tellurium compounds and colloidal tellurium. Specifically, the compounds disclosed in U.S. Pat. Nos. 1,623,499, 3,320,069 and 3,772,031, British Patents 235,211, 1,121,496, 1,295,462 and 1,396,696, Canadian Patent 800,958, JP-A-4-204640, Japanese Patent Application Nos. 3-53693, 3-131598 and 4-129787, *J. Chem. Soc. Chem. Commun.*, 635(1980), ibid., 1102(1979), ibid., 645(1979), *J. Chem. Soc. Perkin Trans.* 1, 2191(1980), and S. Patai (compiler) *The Chemistry of Organic Selenium and Tellurium Compounds*, vol. 1 (1986), vol. 2 (1987) can be used. In particular, the compounds represented by formulae (II), (III) and (IV) in JP-A-5-313284 are preferred over the other compounds.

Each of the amounts of selenium and tellurium sensitizers used in the invention, though depends on the silver halide grains used, chemical ripening conditions and so on, is generally from $1\times10^{-8}$ to $1\times10^{-2}$ mole, preferably from $1\times10^{-7}$ to $1\times10^{-3}$ mole, per mole of silver halide. As to the conditions for chemical sensitization, there are no particular restrictions in the invention. However, it is desirable that the pH be from 5 to 8, the pAg be from 6 to 11, preferably from 7 to 10, and the temperature be from 40 to 95° C., preferably from 45 to 85° C.

In producing a silver halide emulsion used in the invention, cadmium salts, zinc salts, lead salts and thallium salts may also be present at the time the silver halide grains are formed or ripened physically.

To the invention, reduction sensitization can be applied. The reduction sensitization can be achieved by the use of, e.g., ascorbic acid, thiourea dioxide, stannous chloride, aminoiminomethanesulfinic acid, hydrazine derivatives, borane compounds, silane compounds or polyamine compounds. Another method usable for reduction sensitization consists in ripening the emulsion as the pH and pAg thereof are kept at 7 or above and 8.3 or below respectively. As still another method, a single addition period is introduced in the course of grain formation to achieve the reduction sensitization.

To the present silver halide emulsions, thiosulfonic acid compounds may be added using the method disclosed in EP-A-0293917.

In the photosensitive materials according to the invention, only one kind of silver halide emulsion may be used, or two or more kinds of silver halide emulsions (e.g., emulsions differing in average grain size, halide composition, crystal habit, or condition for chemical sensitization) may be used in combination.

The suitable amount of light-sensitive silver halide used in the invention is from 0.01 to 0.5 mole, preferably from 0.02 to 0.3 mole, particularly preferably from 0.03 to 0.25 mole, per mole of organic silver salt. With respect to the method and condition for mixing separately prepared light-sensitive silver halide and organic silver salt, one can adopt a method of mixing separately prepared light-sensitive silver halide and organic silver salt by means of a high-speed stirrer, a ball mill, a sand mill, a colloid mill, a vibrating mill, a homogenizer or the like, or a method of adding previously prepared light-sensitive silver halide to an organic silver salt preparation system at the proper time. However, any method and condition can be adopted as far as the effects aimed at by the invention can be fully achieved.

The appropriate time for the present silver halide addition to a coating composition for the image forming layer is from 180 minutes to just before the coating, preferably from 60 minutes to 10 seconds before the coating. However, there are no particular restrictions as to the mixing method and condition, provided that the effects of the invention can be ensured. As examples of a mixing method usable herein, mention may be made of the mixing method utilizing a tank which enables the adjustment of an average staying time to the intended time, wherein the average staying time is calculated from the addition flow rate and the amount of solution fed to a coater, and the method of using a static mixer as described in *Ekitai Kongo Gijutsu* (English equivalent of which is "The techniques for mixing liquids"), the Japanese version (translated by Koji Takahashi) of the original written by N. Harnby, M. F. Edwards & A. W. Nienow, chapter 8, (published by Nikkan Kogyo Shinbunsha in 1989).

In the present image recording material, it is desirable to contain a reducing agent for organic silver salts. The reducing agent for organic silver salts may be any of substances capable of reducing silver ion to metallic silver, preferably an organic substance having such a reducing power. Although conventional photographic developers, such as phenidone, hydroquinone and catechol, are useful therefor, hindered phenols are preferred as the present reducing agent. The suitable proportion of reducing agent is from 5 to 50 mole %, preferably from 10 to 40 mole %, to the silver present on the image forming layer side. The layer to which the reducing agent is added may be any of the constituent layers provided on the image forming layer side. When the reducing agent is added to a layer other than the image forming layer, it is desirable that the proportion thereof to silver be increased to 10–50 mole %. On the other hand, the reducing agent may be the so-called precursor, or a reducing agent modified so as to function effectively only upon development.

A wide variety of reducing agents which are applicable to the organic silver salt-utilized image recording materials are disclosed in, e.g., JP-A-46-6077, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,958, 3,679,426, 3,751,252, 3,751,255, 3,761,270, 3,782,949, 3,839,048, 3,928,686 and 5,464,738, German Patent 2,321,328, and European Patent 0692732. Specifically, such reducing agents include amidoximes such as phenylamidoxime, 2-thienylamidoxime and p-phenoxyphenylamidoxime; azines, such as 4-hydroxy-3,5-dimethoxybenzaldehydoazine; combinations of aliphatic carboxylic acid arylhydrazides with ascorbic acid, such as the combination of 2,2'-bis(hydroxymethy)propionyl-β-phenylhydrazine with ascorbic acid; the combinations of polyhydroxybenzenes with hydroxylamines, reductones and/or hydrazines, such as the combination of hydroquinone with bis(ethoxyethyl)hydroxylamine, piperidinohexose reductone or formyl-4-methylphenylhydrazine; hydroxamic acids, such as phenylhydroxamic acid, p-hydroxyphenylhydroxamic acid and β-anilinohydroxamic acid; combinations of azines with sulfonamidophenols, such as the combination of phenothiazine with 2,6-dichloro-4-benzenesulfonamidophenol; α-cyano-phenylacetic acid derivatives, such as ethyl-α-cyano-2-methylphenylacetate and ethyl-α-cyanophenylacetate; bis-β-naphthols, such as 2,2'-dihydroxy-1,1,'-binaphthyl, 6,6'-dibromo-2,2-dihydroxy-1,1'-binaphthyl and bis(2-hydroxy-1-naphthyl) methane; combinations of bis-β-naphthols with 1,3-dihydroxybenzene derivatives (e.g., 2,4-dihydroxybenzophenone, 2',4'-dihydroxyacetophenone); 5-pyrazolones, such as 3-methyl-1-phenyl-5-pyrazolone; reductones, such as dimethylaminohexose reductone, anhydrodihydroaminohexose reductone and anhydrodihydropiperidonehexose reductone; sulfonamidophenol reducing agents, such as 2,6-dichloro-4-benzenesulfonamidophenol and p-benzenesulfonamidophenol; 2-phenylindane-1,3-dione; chromans, such as. 2,2-dimethyl-7-t-butyl-6-hydroxychroman; 1,4-dihydropyridines, such as 2,6-dimethoxy-3,5-dicarboethoxy-1,4-dihydropyridine; bisphenols, such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives, such as 1-ascorbyl palmitate and ascorbyl stearate; aldehydes and ketones of benzil, biacetyl and the like; 3-pyrazolidones and certain indane-1,3-diones; and chromanols, such as tocophenols. Of these compounds, bisphenols and chromanols are particularly preferred as reducing agent.

Such reducing agents may be incorporated as a solution, a powder, a dispersion of solid fine particles, or so on. The dispersion of solid fine particles can be prepared using a conventional means of finely grinding a solid (e.g., a ball mill, a vibrating ball mill, a sand mill, a colloid mill, a jet mill, a roller mill). In dispersing solid fine particles, a dispersing aid may be used.

Incorporation of the additive known as "a toning agent" for improvement in image quality into the present image recording materials sometimes causes a rise in optical density. Occasionally, it is favorable for the formation of black silver image, too. It is desirable for the toning agent to be incorporated in a proportion of 0.1 to 50 mole %, preferably 0.5 to 20 mole %, to the silver present on the image forming layer side. The toning agent may be the so-called precursor, or a toning agent modified so as to function effectively only upon development.

A wide variety of toning agents which are applicable to the organic silver salt-utilized image recording materials are disclosedin, e.g., JP-A-46-6074, JP-A-47-10282, JP-A-49-5019, JP-A-49-46427, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727 (the term "JP-B" as used herein means an "examined Japanese patent publication"), JP-B-54-20333, U.S. Pat. Nos. 3,080,254, 3,446,648, 3,782,941, 4,123,282 and 4,510,236, British Patent 1,380,795, and Belgian Patent 841,910. Specifically, such toning agents include phthalimide and N-hydroxyphthallimide; cyclic imides, such as succinimide, pyrazoline-5-one, quinazoline, 3-phenyl-2-pyrazoline-5-one, 1-phenylurazole, quinazoline and 2,4-thiazolidinedione; naphthalimides, such as N-hydroxy-1,8-naphthalimide; cobalt complexes, such as cobalt hexamminetrifluoroacetate; mercaptanes, such as 3-mercapto-1,2,4-triazole, 2,4-dimercaptopyrimidine, 3-mercapto-4,5-diphenyl-1,2,4-trizole and 2,5-dimercpato-1,2,4-thiadiazole; N-(aminomethyl)aryl-dicarboxyimides, such as (N,N-dimethylamino)phthalimide and N,N-(dimethylaminomethyl)-naphthalene-2,3-dicarboxyimide; blocked pyrazoles, isothiuronium derivatives and certain photo-discoloration agents, e.g., N,N'-hexamethylenebis(l-carbamoyl-3,5-dimethylpyrazole), 1,8-(3,6-diazaoctane)bis-(isothiuronium trifluoroacetate) and 2-tribromomethylsulfonylbenzothiazole; 3-ethyl-5[(3-ethyl-2-benzothiazolinyl-idene)-1-methylethylidene]2-thio-2,4-oxazolidinedione; phthalazinone, metal salts of phthalazinone, or phthalazinone derivatives such as 4-(1-naphthyl)phthalazinone, 6-chloro-phthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, tetrachlorophthalic anhydride); phthalazine, metal salts of phthalazine, or phthalazine derivatives such as 4-(1-naphthyl)phthalazine, 6-isopropylphthalazine, 6-tert-butylphthalazine, 6-chlorophthalazine, 5,7-dimethoxyphthalazine and 2,3-dihydrophthalazine; combinations of phthalazine with phthalic acid derivatives (e.g., phthalic acid, 4-methylphthalic acid, 4-nitrophthalic acid, tetrachlorophthalic anhydride); quinazolinedione, benzoxazine or naphthoxazine derivatives; rhodium complexes functioning as not only a tone modifier but also a halide ion source for forming silver halide on the spot, such as ammonium hexachlororhodate(III), rhodium bromide, rhodium nitrate and potassium hexachlororhodate(III); inorganic peroxides and persulfates, such as ammonium peroxide disulfide and hydrogen peroxide; benzoxazine-2,4-diones, such as 1,3-benzoxazine-2,4-dione, 8-methyl-1,3-benzoxazine-2,4-dione and 6-nitro-1,3-benzoxazine-2,4-dione; pyrimidines and asymmetric triazines, such as 2,4-dihydroxypyrimidine and 2-hydroxy-4-aminopyrimidine, azauracil, and tetraazapentalene derivatives (e.g., 3,6-dimercapto-1,4-diphenyl-1H,4H-2,3a,5,6a-tetraazapentalene, 1,4-di(o-chlorophenyl)-3,6-dimercapto-1H,4H-2,3a,5,6a-tetraazapentalene); and so on.

Such toning agents may be added as a solution, a powder, a dispersion of solid fine particles, or so on. The dispersion of solid fine particles can be prepared using a conventional means of finely grinding a solid (e.g., a ball mill, a vibrating ball mill, a sand mill, a colloid mill, a jet mill, a roller mill). In dispersing solid fine particles, a dispersing aid may be used.

In the invention, the organic silver salt layer as an image forming layer is preferably provided by coating and drying a coating composition which contains water in a proportion of at least 30 weight % of the total solvent and a binder (hereinafter referred to as "the present polymer") in a state of aqueous latex, or polymer dissolved or dispersed in a water-base solvent (water solvent), particularly a polymer latex having an equilibrium moisture content of at most 2 weight % under the condition of 25° C.–60% RH. The most suitable form consists in the organic silver salt layer prepared so as to have an ionic conductivity of 2.5 mS/cm at the most. In order to prepare such a layer, one can adopt the method of purifying a polymer product by the use of a separatory function film.

The water-base solvent in which the present polymer can be dissolved or dispersed includes water and mixtures prepared by mixing water with at most 70 weight % of water-miscible organic solvents. As examples of a water-miscible organic solvent, mention may be made of alcohols such as methyl alcohol, ethyl alcohol and propyl alcohol, cellosolves such as methyl cellosolve, ethyl cellosolve and butyl cellosolve, ethyl acetate and dimethylformamide.

Herein, even the solvent system in which the polymer is not dissolved thermodynamically but in a dispersed state is expressed using the term "water-base solvent".

The term "equilibrium moisture content under the condition of 25° C.–60% RH" is defined as the following equation, wherein W1 stands for the weight of a polymer in a humidity equilibrium state in the atmosphere of 25° C.–60% RH and W0 stands for the weight of the polymer in an absolutely dried state at 25° C.:

$$\text{Equilibrium moisture content under } 25^\circ\text{ C.–60\% RH} = \{(W1-W0)/W0\}\times 100 \text{ (weight \%)}$$

For details of the definition and the measurement method of the moisture content, e.g., *Lectures on Polymer Engineering*, vol. 14, the chapter entitled "Polymer material testing methods" (compiled by Polymer Society and published by Chijinn Shokan) can be referred to.

The suitable equilibrium moisture content of the present polymer under 25° C.–60% RH is 2 weight % at the most, preferably from 0.01 to 1.5 weight %, more preferably from 0.02 to 1 weight %.

The present polymers have no particular restrictions as far as they are soluble or dispersible in the foregoing water-base solvents and have an equilibrium moisture content of at most 2 weight % under 25° C.–60% RH. Of such polymers, the polymers dispersible in water-base solvents are preferred in particular.

As examples of a dispersed state of such polymers, mention may be made of a latex in which fine solid particles of polymer is dispersed and a dispersion of polymer molecules in a molecular state or in a condition of micelle formation. Both the latex and the dispersion are favored.

The polymers usable in preferred embodiments of the invention are hydrophobic polymers, such as acrylic resin, polyester resin, rubber resin (e.g., SBR resin), polyurethane resin, vinyl chloride resin, vinyl acetate resin, vinylidene chloride resin and polyolefin resin. As for the structure, those polymers may be straight-chain polymers, branched polymers or cross-linked polymers. As for the constitutional units, they may be the so-called homopolymers, namely those produced by polymerizing monomers of the same kind, or copolymers produced by polymerizing two or more different kinds of monomers. These copolymers maybe random copolymers or block copolymers. The molecular weight of such polymers is on number average from 5,000 to 1,000,000, preferably from 10,000 to 200,000. When the molecular weight of the polymer is too low, the resulting emulsion cannot have sufficient mechanical strength, while the polymers having too high molecular weight cannot have satisfactory film formability.

The present polymers are dispersions of the above-recited polymers in water-base dispersion media. The term "water-base dispersion medium" as used herein refers to the dispersion medium containing water in a proportion of at least 30 weight %. As for the dispersed state, the polymers may be dispersed in an emulsified state or a micelles-formed state, or the polymers having hydrophilic moieties may be dispersed in a molecular state. Of these dispersions, latex is preferred in particular.

Suitable examples of a polymer used in the invention are recited below. Therein, each polymer is represented by monomers used as starting materials, the figure in parentheses is the proportion of each monomer, expressed in weight %, and Mn stands for number average molecular weight.

P-1: MMA(70)-EA(27)-MAA(3) latex (Mn: 37,000)
P-2: MMA-(70)-2EHA820)-St(5)-AA(5) latex (Mn: 40,000)
P-3: St(50)-Bu(47)-MAA(3) latex (Mn: 45,000)
P-4: St(68)-Bu(29)-AA(3) latex (Mn: 60,000)
P-5: St(70)-Bu(27)-I(3) latex (Mn: 120,000)
P-6: St(75)-Bu(24)-AA(l) latex (Mn: 108,000)
P-7: St(60)-Bu(35)-DVB(3)-MAA(2) latex (Mn: 150,000)
P-8: St(70)-Bu(25)-DVB(2)-AA(3) latex (Mn: 280,000)
P-9: VC(50)-MMA(20)-EA(20)-AN(5)-AA(5) latex (Mn: 80,000)
P-10: VDC(85)-MMA(5)-EA(5)-MAA(5) latex (Mn: 67,000)
P-11: Et(90)-MAA(10) latex (Mn: 12,000)

The monomers represented by the above symbols are as follows: MMA stands for methyl methacrylate, EA stands for ethyl acrylate, MAA stands for methacrylic acid, 2EHA stands for 2-ethylhexylacrylate, St stands for styrene, Bu stands for butadiene, AA stands for acrylic acid, DVB stands for divinylbenzene, VC stands for vinyl chloride, AN stands for acrylonitrile, VDC stands for vinylidene chloride, ET stands for ethylene, and IA stands for itaconic acid.

The above-recited polymers are available on the market, and the following ones can be utilized. Examples of commercial acrylic resin include Sebian A-4635, 46583, 4601 (products of Daisel Ltd.) and Nipol Lx811, 814, 821, 820, 857 (products of Japanese Geon Co., Ltd.). Examples of commercial polyester resin include FINETEX ES650, 611, 675, 850 (products of Dai-Nippon Ink & Chemicals Inc.) and WD-size, WMS (products of Eastman Chemical). Examples of commercial polyurethane resin include HYDRAN AP10, 20, 30 and 40 (products of Dai-Nippon Ink & Chemicals Inc.); those of commercial rubber resin include LACSTAR 7310K, 3307B, 4700H and 7132° C. (products of Dai-Nippon Ink & Chemicals Inc.), and Nipol Lx416, 410, 438° C. and 2507 (products of Japanese Geon Co., Ltd.); those of commercial vinyl chloride resin include G351 and G576 (products of Japanese Geon Co., Ltd.); those of commercial vinylidene chloride resin include L502 and L513 (products of Asahi Chemical Industry Co., Ltd.); and those of commercial olefin resin include Chemi Pearl S120 and SA100 (products of Mitsui Petrochemical Industries, Ltd.).

These polymers may be used alone as polymer latex, or a blend of two or more thereof may be used, if desired.

In particular, it is desirable for the polymer-latex used in the invention to be a styrene-butadine copolymer latex. The suitable ratio of styrene monomer units to butadiene monomer units in the styrene-butadiene copolymer is from 40:60 to 95:5 by weight. The total proportion of these monomer units in the copolymer is preferably from 60 to 90 weight %. The suitable molecular weight range of the copolymer is the same as mentioned above.

Examples of a styrene-butadiene copolymer latex suitable for the invention include the foregoing lateces P-3 to P-8, and commercial products LACSTAR 3307B, LACSTAR 7132C and Nipol Lx416.

It is preferred to add heat to the latex at 50 to 95° C., preferably 70 to 90° C., for 2 to 15 hours, preferably 3 to 10 hours, after synthesis.

To the organic silver salt-containing layer of the present image recording material may be added a hydrophilic polymer, such as gelatin, polyvinyl alcohol, methyl cellulose or hydroxypropyl cellulose, if needed. The proportion of such a hydrophilic polymer to the total binders in the organic silver salt containing layer is not higher than 30 weight %, preferably not higher than 20 weight %.

The organic silver salt containing layer formed in the invention comprises a polymer latex as binder. In the organic silver salt containing layer, the suitable ratio of the total binders to the organic silver salt is from 1/10 to 10/1 by weight, preferably from 1/5 to 4/1 by weight.

In general, such an organic silver salt containing layer of a photosensitive image recording material is also a photosensitive layer (emulsion layer) comprising light-sensitive silver halide. In this case, the suitable ratio of the total binders to the silver halide is from 400/1 to 5/1 by weight, preferably from 200/1 to 10/1 by weight.

The suitable amount of total binders contained in the present image forming layer is 0.2–30 g per $m^2$, preferably 1–15 g per $m^2$. To the present image forming layer may be added a cross-linking agent and a surfactant for improving coating properties.

The solvent (for simplification, the term "solvent" used herein is intended to include both solvent and dispersing medium) used in a coating solution for forming an organic silver salt containing layer of the present image recording material is a water-base solvent containing water in a proportion of at least 30 weight %. As components other than water, any of water-miscible organic solvents, such as methyl alcohol, ethyl alcohol, iospropyl alcohol, methyl cellosolve, ethyl cellosolve, dimethylformamide and ethyl acetate, may be used. The suitable content of water in the solvent of the coating solution is at least 50 weight %, preferably at least 70 weight %. Suitable examples of a solvent composition include water=100, water/methyl alcohol=90/10, water/methyl alcohol=70/30, water/methyl alcohol/dimethylformamide=80/15/5, water/methyl alcohol/ethyl cellosolve=85/10/5, and water/methyl alcohol/isopropyl alcohol=85/10/5 (wherein all the figures are by weight %).

Any of sensitizing dyes can be used in the invention as far as they can adsorb to silver halide grains and spectrally sensitize the silver halide grains in the intended wavelength region. Specifically, cyaninedyes, merocyaninedyes, complex cyanine dyes, complex merocyanine dyes, holopolar cyanine dyes, styryl dyes, hemicyanine dyes, oxonol dyes, hemioxonol dyes and the like can be used as sensitizing dyes. The sensitizing dyes useful for the invention are described in, e.g., *Research Disclosure*, No.17643, item IV-A, page 23 (Dec., 1978), ibid., No. 1831, item X, page 437 (August, 1979), and the references cited therein. In particular, it is profitable to select therefrom the sensitizing dyes having spectral sensitivities suited for the spectral characteristics of light sources used in various kinds of laser imagers, scanners, image setters and process cameras.

For the spectral sensitization to red light, or the light from the so-called red light source, such as He-Ne laser, red semiconductor laser or LED, the Compounds I-1 to I-38 disclosed in JP-A-54-18726, the Compounds I-1 to I-35 disclosed in JP-A-6-75322, the Compounds I-1 to I-34 disclosed in JP-A-7-287338, the Dyes 1 to 20 disclosed in JP-B-55-39818, the Compounds I-1 to I-37 disclosed in JP-A-62-284343 and the Compounds I-1 to I-34 disclosed in JP-A-7-287338 can be selected to advantage.

When the semiconductor laser beams of wavelengths ranging from 750 nm to 1,400 nm are used as a light source, spectral sensitization can be achieved favorably by the use of various known dyes including cyanine, merocyanine, styryl, hemicyanine, oxonol, hemioxonol and xanthene dyes. The useful cyanine dyes are cyanine dyes having basic nuclei, such as thiazoline, oxazoline, pyrroline, pyridine, oxazole, thiazole, selenazole and imidazole nuclei. The very useful merocyanine dyes are merocyanine dyes having not only the basic nuclei as recited above but also acidic nuclei, such as thiohydantoin, rhodanine, oxazolidinedione, thiazolinedione, barbituric acid, thiazolinone, malononitrile and pyrazolone nuclei. Of the above-recited cyanine and merocyanine dyes, those having imino or carboxyl groups produce particularly great effect. For instance, the sensitizing dyes can be selected properly from the known dyes as disclosed in U.S. Pat. Nos. 3,761,279, 3,719,495 and 3,877,943, British Patents 1,466,201, 1,469,117 and 1,422,057, JP-B-3-10391, JP-B-6-52387, JP-A-5-341432, JP-A-6-194781 and JP-A-6-301141.

As examples of a dye having a structure particularly favorable for the spectral sensitization in the invention, mention may be made of cyanine dyes having thioether linkage-containing substituent groups (e.g., the dyes disclosed in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-5-324425, JP-W-7-500926 (the term "JP-W" as used herein means a "Japanese patent official announcement") and U.S. Pat. No. 5,541,054), dyes having carboxylic acid groups (e.g., the dyes disclosed in JP-A-3-163440, JP-A-6-301141 and U.S. Pat. No. 5,441,899), merocyanine dyes, polynuclear merocyanine dyes and polynuclear cyanine dyes (e.g., the dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-W-55-50111, British Patent 1,467,638 and U.S. Pat. No. 5,281,515).

Further, the dyes forming the J-band are disclosed in U.S. Pat. No. 5,510,236, U.S. Pat. No. 3,871,887 (the dyes in Example 5), JP-A-2-96131 and JP-A-59-48753, and these dyes can be used to advantage in the invention.

Those sensitizing dyes can be used alone or as combination of two or more thereof. Combinations of sensitizing dyes are often employed particularly for the purpose of supersensitization. Substances which can exhibit a supersensitizing effect in combination with a certain sensitizing dye although they themselves do not spectrally sensitize silver halide emulsions or do not absorb light in the visible region may be incorporated into the silver halide emulsions. The useful sensitizing dyes, the supersensitizing combinations of dyes and the substances exhibiting supersensitizing effect are disclosedin *Research Disclosure*, vol. 176, No. 17643, item IV, page 23 (December, 1978), JP-B-49-25500, JP-A-43-4933, JP-A-59-19032 and JP-A-59-192242.

In adding sensitizing dyes to a silver halide emulsion, they may be added directly to the emulsion, or dissolved in a solvent, such as water, methanol, ethanol, propanol, acetone, methyl cellosolve, 2,2,3,3,-tetrafluoropropanol, 2,2,2-trifluoroethanol, 3-methoxy-1-propanol, 3-methoxy-1-butanol, 1-methoxy-2-propanol, N,N-dimethylformamide or a mixture of two or more thereof, and then added to the emulsion.

Further, it is possible to adopt the method disclosed in, e.g., U.S. Pat. No. 3,469,987, wherein the dyes are dissolved in a volatile organic solvent, dispersed into water or a hydrophilic colloid, and then added to the emulsion; the method disclosed in, e.g., JP-A-44-23389, JP-A-44-27555 and JP-B-57-22091, wherein the dyes are dissolved in an acid and then added to the emulsion, or they are formed into a water solution in the presence of an acid or an alkali and then added to the emulsion; the method disclosed in, e.g., U.S. Pat. Nos. 3,822,135 and 4, 006,025, wherein the dyes are formed into a water solution or a colloidal dispersion in the presence of a surfactant and then added to the emulsion; the method disclosed in JP-A-53-102733 and JP-A-58-105141, wherein the dyes are dispersed directly into a hydrophilic colloid and then added to the emulsion; and the method disclosed in JP-A-51-74624, wherein the dyes are dissolved using a red shift compound and then added to the emulsion. In addition, the dissolution of dyes can be performed by the use of ultrasonic waves.

The sensitizing dyes may be added to the present silver halide emulsions at any stage in the process of making the emulsion as far as the stage has so far been recognized as to be useful. For instance, the time at which the sensitizing dyes are added to a silver halide emulsion may be the step of forming silver halide grains or/and before desalting the emulsion, or the step of desalting the emulsion and/or the period from the conclusion of desalting to the beginning of chemical ripening, as disclosed in U.S. Pat. Nos. 2,735,766, 3,628,960, 4,183,756 and 4,225,666, JP-A-58-184142 and JP-A-60-196749. As disclosed in JP-A-58-113920, the addition time may also be right before or during the chemical ripening, or any stage in the period from the conclusion of chemical ripening to the beginning of emulsion-coating. Further, as disclosed in, e.g., U.S. Pat. No. 4,225,666 and JP-A-58-7629, the same compound or the combination of compounds having different structures is divided into portions and added in separate steps, e.g., the step of forming silver halide grains, the step of chemically ripening the grains and the step after completing the chemical ripening respectively, or the steps before, during and after formation of grains respectively. In divided addition, different dyes or different combinations of dyes may also be used in separate steps.

The amount of sensitizing dyes used in the invention can be determined properly depending on the properties of the grains to be sensitized, such as the sensitivity and the fog density. Specifically, the suitable amount thereof is from $10^{-6}$ to 1 mole, preferably from $10^{-4}$ to $10^{-1}$ mole, per mole of silver halide.

By the use of an antifoggant, a stabilizer or a precursor of stabilizer, the silver halide emulsions and/or organic silver salts used in the invention can be further protected against additional fog formation and stabilized to a drop in sensitivity during the storage of stock. Suitable examples of an antifoggant, a stabilizer and precursors of a stabilizer, which can be used independently or in combination, include the thiazonium salts disclosed in U.S. Pat. Nos. 2,131,038 and 2,694,716, the azaindenes disclosed in U.S. Pat. Nos. 2,886,437 and 2,444,605, the mercury salts disclosed in U.S. Pat. No. 2,728,663, the urazoles disclosed in U.S. Pat. No. 3,287,135, the sulfocatechols disclosed in U.S. Pat. No. 3,235,652, the oximes, the nitrons and the nitroindazoles disclosed in British Patent 623,448, the polyvalent metal salts disclosed in U.S. Pat. No. 2,839,405, the thiuronium salts disclosed in U.S. Pat. No. 3, 220, 839, the palladium, platinum and gold salts disclosed in U.S. Pat. Nos. 2,566,263 and 2,597,915, the halogen-substituted organic compounds disclosed in U.S. Pat. Nos. 4,108,665 and 4,442,202, the triazines disclosed in 4,128,557, 4,137,079, 4,138,365 and 4,459,350, and the phosphorus compounds disclosed in U.S. Pat. No. 4,411,935.

With respect to the antifoggants used to advantage in the invention, it is also desirable that the compounds of formula (1) with organic halides be used together with organic halides. Examples of such organic halides include the compounds disclosed in JP-A-50-119624, JP-A-50-120328, JP-A-51-121332, JP-A-54-58022, JP-A-56-70543, JP-A-56-99335; JP-A-59-90842, JP-A-61-129642, JP-A-62-129845, JP-A-6-208191, JP-A-7-5621, JP-A-7-2781, JP-A-8-15809, and U.S. Pat. Nos. 5,340,712, 5,369,000 and 5,464,737.

In adding the present antifoggants, they may be in any state, e.g., the state of being dissolved, pulverized, or dispersed as solid fine particles, or so on. The dispersion of solid fine particles can be prepared using a conventional means for finely grinding a solid (e.g., a ball mill, a vibrating ball mill, a sand mill, a colloid mill, a jet mill, a roller mill). In dispersing solid fine particles, a dispersing aid may be used.

The addition of a mercury(II) salt as antifoggant is unnecessary for putting the invention in practice, but in some cases it can produce beneficial effect. The mercury(II) salts suitable for such cases are mercury acetate and mercury bromide. The suitable amount of mercury added in the invention is from $1\times10^{-9}$ to $1\times10^{-3}$ mole, preferably from $1\times10^{-9}$ to $1\times10^{-4}$ mole, per mole of coated silver.

With the intention of increasing the sensitivity and preventing the fog, benzoic acids may be added to the present image recording materials. Such benzoic acids may be any of benzoic acid derivatives, but the compounds disclosed in U.S. Pat. Nos. 4,784,939 and 4,152,160 and Japanese Patent Application Nos. 8-151242, 8-151241 and 8-98051 are used to advantage because of their structures. The benzoic acids may be added to any part of the image recording material, but it is desirable to add them to a layer arranged on the same side as the image forming layer, especially to the organic silver salt containing layer. The addition time of benzoic acids in the invention may be any step in the process of preparing the coating solution. In a case where the benzoic acids are added to the organic silver salt containing layer, the addition time may be any step in the period from the preparation of organic silver salts to the preparation of the coating solution. However, it is preferable that they be added during the period from the completion of organic silver salt preparation to just before coating. As for the addition manner, the benzoic acids may be added in any form, e.g., a solution, a powder or a dispersion of solid fine particles. Further, they may be added as a solution of mixture with other additives, such as sensitizing dyes, a reducing agent and a toning agent. The benzoic acids maybe added in any amount, but it is preferable to add them in an amount of $1\times10^{-6}$ to 2 moles, especially $1\times10^{-3}$ to 0.5 mole, per mole of silver.

For the purpose of controlling the development by retardation or acceleration, enhancing the spectral sensitization efficiency and improving the keeping quality before and after development, mercapto compounds, disulfide compounds and thione compounds can be incorporated in the present image recording materials.

The mercapto compounds used in the invention, though may have any structure, are preferably compounds represented by Ar—SM or Ar—S—S—Ar. In these formulae, M represents a hydrogen atom or an alkali metal atom, and Ar represents an aromatic or condensed aromatic ring group containing at least one nitrogen, sulfur, oxygen, selenium or tellurium atom. Suitable examples of an aromatic hetero ring in the group as Ar include benzimidazole, naphthimidazole, benzothiazole, naphthothiazole, benzoxazole, naphthoxazole, benzoselenazole, benzotellurazole, imidazole, oxazole, pyrazole, triazole, thiadiazole, teterazole, triazine, pyrimidine, pyridazine, pyrazine, pyridine, purine, qunoline and quinazolinone. Each of these aromatic hetero rings may have one or more substituents selected from the group consisting of halogen atoms (e.g., Br and Cl), a hydroxyl group, an amino group, a carboxyl group, alkyl groups (e.g., an alkyl group containing at least one carbon atom, preferably 1 to 4 carbon atoms) and alkoxy groups (e.g., an alkoxy group containing at least one carbon atom, preferably 1 to 4 carbon atoms). Examples of a mercaptosubstituted aromatic heterocyclic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-benzothiazole, 3-mercapto-1,2,4-triazole, 4, 5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercapto-pyrimidinemonohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4.6-diamino-2-mercaptopyrimidine, 2-mercapto-4-methylpyrimidine hydrochloride, 3-mercapto-5-phenyl-1,2,4-triazole, and 2-mercapto-4-phenyloxazole. However, these examples should not be construed as limiting the scope of the invention.

The suitable amount of such mercapto compounds added is from 0.001 to 1.0 mole, preferably from 0.01 to 0.3 mole, per mole of silver in the emulsion.

In the present image forming layer, the polyhydric alcohols (e.g., glycerines and diols as disclosed in U.S. Pat. No. 2,960,404), the fatty acids or the esters thereof as disclosed in U.S. Pat. Nos. 2,588,765 and 3,121,060, and the silicone oils disclosed in British Patent 955, 061 can be used as plasticizer and lubricant.

The invention can use a nucleating agent for the formation of ultra-high contrast images. As such an agent can be used the hydrazine derivatives disclosed in U.S. Pat. Nos. 5,464, 738, 5,496,695, 6,512,411 and 5,536,622, and Japanese Patent Application Nos. 7-228627, 8-215822, 8-130842, 8-148113, 8-156378, 8-148111 and 8-148116, the quaternary nitrogen atom-containing compounds disclosed in Japanese Patent Application No. 8-83566, or the acrylonitrile compounds disclosed in U.S. Pat. No. 5,545,515. As examples of those compounds, mention may be made of the Compounds 1 to 10 disclosed in U.S. Pat. No. 5,464,738, the Compounds H-1 to H-28 disclosed in U.S. Pat. No. 5,496, 695, the Compounds I-1 to I-86 disclosed in Japanese Patent Application No. 8-215822, the Compounds H-1 to H-62 disclosed in Japanese Patent Application No. 8-130842, the compounds 1-1 to 1–21 disclosed in Japanese Patent Application No. 8-148113, the Compound 1 to 50 disclosed in Japanese Patent Application No. 8-148111, the Compounds 1 to 40 disclosed in Japanese Patent Application No. 8-148116, the Compounds P-1 to P-26 and the Compounds T-1 to T-18 disclosed in Japanese Patent Application No. 8-83566, and the Compounds CN-1 to CN-13 disclosed in U.S. Pat. No. 5,545,515.

In order to form ultra-high contrast images in the invention also, nucleating accelerators can be used together with the nucleating agents recited above. Examples of such accelerators include the amine compounds disclosed in U.S. Pat. No. 5,545,505, specifically AM-1 to AM-5, the hydroxamic acids disclosed in U.S. Pat. No. 5,545,507, specifically HA-1 to HA-11, the acrylonitriles disclosed in U.S. Pat. No. 5,545,507, specifically CN-1 to CN-13, the hydrazine compounds disclosed in U.S. Pat. No. 5,558,983, specifically CA-1 to CA-6, and the onium salts disclosed in Japanese Patent Application No. 8-132836, specifically A-1 to A-42, B-1 to B-27 and C-1 to C-14.

Those nucleating agents and nucleating accelerators can be synthesized and added in the same manners as described in the corresponding references cited above. For the addition amounts thereof those references can be referred, too.

The present image recording materials each can be provided with a surface protective layer for the purpose of preventing the adhesion of an image forming layer.

In the surface protective layer, any polymer may be used as binder. Preferably, the present protective layer contains a polymer having carboxylic acid residues at a coverage of 100 mg/m$^2$ to 5 g/m$^2$. Examples of such a polymer include natural polymers (e.g., gelatin, alginic acid), denatured natural polymers (e.g., carboxymethyl cellulose, phthaloylated gelatin) and synthetic polymers (e.g., polymethacrylate, polyacrylate, alkylmethacrylate/acrylatle copolymer, styrene/methacrylate copolymer). The suitable content of carboxyl residues in those polymers is from $1\times10^{-2}$ mole to 1.4 moles per 100 g of polymer. Additionally, the carboxylic acid residues may form salts by replacing their hydrogen ions with alkali metal ions, alkaline earthmetal ions or organic cations.

In the present surface protective layer, any adhesion inhibitive material may be used. Examples of such a material include wax, silica grains, styrene-containing elastomeric block copolymers (e.g., styrene-butadiene-styrene copolymer, styrene-isoprene-styrene copolymer), cellulose acetate, cellulose acetate butyrate, cellulose propionate and mixtures of two or more thereof. Further, the surface protective layer may contain a cross-linking agent and a surfactant for improvement of coating properties.

In the present image forming layer or the protective layer therefor, the light absorbing materials and filter dyes disclosed in U.S. Pat. Nos. 3,253,921, 2,274,782, 2,527,583 and 2,956,879 can be used. Further, the dyes can be mordanted as described in, e.g., U.S. Pat. No. 3,282,699. It is desirable to use the filter dyes in an amount to provide an absorbance of 0.1 to 3.0, preferably 0.2 to 1.4, at the exposure wavelength.

In the present image forming layer or the protective layer therefor can be contained a matting agent, such as starch, titanium dioxide, zinc oxide, silica and polymer beads of the types disclosed in U.S. Pat. Nos. 2,992,101 and 2,701,245. The present image recording materials may have any matte degree on the emulsion side. Preferably, they have the matte degree ranging from 50 to 10,000 seconds, particularly from 80 to 10,000 seconds, expressed in terms of Bekk smoothness.

The suitable temperature at which the coating solutions for the present image forming layers are prepared is from 30° C. to 65° C., preferably from 35° C. to lower than 65° C. (especially 55° C. or below). Further, it is desirable that the coating solution for image forming layer be kept at a temperature of 30–65° C. just after adding a polymer latex there to. Furthermore, it is favorable that the reducing agent and the organic silver salt be mixed prior to the addition of the polymer latex.

The organic silver salt containing fluid used in the invention or the coating solution for the present image forming layer is preferably the so-called thixotropy fluid. The term thixotropy refers to the property of lowering viscosity with an increase in shear rate. The viscosity measurement in the invention may be taken with any apparatus. Preferably, the measurement is carried out at 25° C. with an RFS froude spectrometer made by Rheometric Far East Inc. It is desirable that the present organic silver salt containing fluid or the coating solution for the present heat image forming layer have a viscosity of 400 to 100,000 mPa·s, preferably 500 to 20,000 mPa·s, at the shear rate of 0.1 $S^{-1}$. When it is measured at the shear rate of 1,000 $S^{-1}$, the viscosity of the foregoing fluid or solution is preferably from 1 to 200 mPa·s, more preferably from 5 to 80 mPa·s.

Various systems are known to develop thixotropy. For instance, such systems are described in the books entitled "Koza, Rheology", compiled by Kohbunshi Kankohkai, and "Kohbunshi Latex" written by Muroi and Morino (published by Kohbunshi Kankohkai). In order to make the fluid develop thixotropy, it is necessary to incorporate a great quantity of solid fine particles in the fluid. For intensifying the thixotropy of a fluid, it is effective that the fluid contains a linear polymer as thickener, the solid fine particles contained therein are anisotropic crystals having a great aspect ratio, and an alkali thickener and a surfactant are added to the fluid.

The present photothermographic emulsions form one or more layers on a support. In a case where the emulsion is formed into a single layer, the layer comprises an organic silver salt, a silver halide, a developer and a binder. Further, the layer can contain additional ingredients, such as a toning agent, a coating aid and other additives, if desired. In another case where a double-layer structure is formed, the first emulsion layer (generally a layer adjacent to the support) comprises an organic silver salt and a silver halide, and the second layer or both layers contain some of the other ingredients. In still another case, the double-layer structure can be constituted of the single emulsion layer containing all the ingredients and a protective top coating. As for the structure of a multicolor photosensitive photothermographic material, the emulsions for each color may take a double-layer structure as mentioned above or, as described in U.S. Pat. No. 4,708,928, may form a single layer containing all the ingredients. In a case of multi-dye multicolor photosensitive photothermographic materials, each emulsion layer is generally kept apart from another emulsion layer (photosensitive layer) by arranging a functional or non-functional barrier layer between them, as disclosed in U.S. Pat. No. 4,460,681.

In the present photosensitive layers, various dyes and pigments can be used from the viewpoints of improving the tone and preventing irradiation. Any dye and pigment may be used in the present photosensitive layers. For instance, the pigments and the dyes listed in Colour Index can be used. Specifically, those pigments and dyes include organic dyes, such as pyrazoloazole dyes, anthraquinone dyes, azo dyes, azomethine dyes, oxonol dyes, carbocyanine dyes, styryl dyes, triphenylmethane dyes, indoaniline dyes and indophenol dyes; organic pigments, such as azo pigments, polycyclic pigments (e.g., phthalocyanine pigments, anthraquinone pigments), dyed lake pigments and azine pigments; and inorganic pigments. Examples of dyes suitable for the invention include anthraquinone dyes (such as the Compounds 1 to 9 disclosed in JP-A-5-341441 and the Compounds 3–6 to 3–18 and 3–23 to 3–38 disclosed in JP-A-5-165147), azomethine dyes (such as the Compound 17 to 47 disclosed in JP-A-5-341441), indoaniline dyes (such as the Compound 11 to 19 disclosed in JP-A-5-289227, the Compound 47 disclosed in JP-A-5-341441 and the Compounds 2–10 and 2–11 disclosed in JP-A-5-165147) and azo dyes (such as the Compounds 10 to 16 disclosed in JP-A-5-341441). Examples of pigments suitable for the invention include indanthrone pigments of anthraquinone type (such as C.I. Pigment Blue 60), phthalocyanine pigments (such as copper phthalocyanines, e.g., C.I. Pigment Blue 15, and metal-free phthalocyanines, e.g., C.I. Pigment Blue 16), triarylcarbonyl pigments of dyed lake pigment type, indigo, and inorganic pigments (such as ultramarine blue and cobalt blue). These dyes and pigments may be added in any manner, e.g., as a solution, an emulsion or a dispersion of solid fine particles, or in a state of being mordanted with a polymeric mordant. The amount of those compounds used is determined depending on the intended absorption. In general, it is desirable to use them in an amount of 1 $\mu$g to 1 g per $m^2$ of image recording material. Further, dioxane pigments, quinacridone pigments or diketopyrrolopyrrole pigments may be used in combination with the above-recited ones for the purpose of controlling the red tone.

The antihalation layer can be arranged at the position farther away from the light source than the photosensitive layer. It is desirable for the antihalation layer to have the maximum absorption of 0.3 to 2 in the intended wavelength region, preferably an absorption of 0.5 to 2 at the exposure wavelengths. And after processing the layer it is desirable that the absorption thereof be 0.001 to below 0.5 in the visible region, and preferable that the optical density thereof be 0.001 to below 0.3.

The antihalation dyes used in the invention may be any dyes as far as they can provide the absorbance spectral shape desired for the antihalation layer, namely they have the absorption as specified above in the intended wavelength region and, after processing, show sufficiently small absorption in the visible region. Examples of such dyes are disclosed in the following references, but these examples should not be construed as limiting the scope of the invention. As for the dyes satisfying the requirements by themselves, the compounds disclosed in JP-A-59-56458, JP-A-2-216140, JP-A-7-13295, JP-A-7-11432, U.S. Pat. No. 5,380,635, JP-A-2-68539 (from page 13, left under column, line 1, to page 14, left under column, line 9) and JP-A-3-24539 (from page 14, left under column, to page 16, right under column) are examples thereof. As for the dyes discolored by processing, the dyes disclosed in JP-A-52-139136, JP-A-53-132334, JP-A-56-501480, JP-A-57-16060, JP-A-57-68831, JP-A-57-10835, JP-A-59-182436, JP-A-7-36145, JP-A-7-199409, JP-B-48-33692, JP-B-50-16648, JP-B-2-41734 and U. S. Pat. Nos. 4,088,497, 4,283,487, 4,548,896 and 5,187,049 are examples thereof.

The present image recording materials are preferably the so-called one-side image recording materials, which each have at least one photosensitive layer comprising a silver halide emulsion (image forming layer) on one side of a support and a backing layer on the other side.

To the present one-side image recording materials, a matting agent may be added for the improvement of conveying properties. Any of the matting agents well known in the art, e.g., the organic matting agents disclosed in U.S. Pat. No. 1,939,213, 2,701,245, 2,322,037, 3,262,782, 3,539,344 and 3,767,448, and the inorganic matting agents disclosed in U.S. Pat. Nos. 1,260,772, 2,192,241, 3,257,206, 3,370,951, 3,523,022 and 3,769,020, can be used. Examples of an organic compound which can be preferably used as matting agent include water-dispersible vinyl polymers, such as polymethyl acrylate, polymethyl methacrylate, polyacrylonitrile, acrylonitrile-$\alpha$-methylstyrene copolymer, polystyrene, styrene-divinylbenzene copolymer, polyvinyl acetate, polyethylene carbonate and polytetrafluoroethylene; cellulose derivatives, such as methyl cellulose, cellulose acetate and cellulose acetate propionate; starch derivatives, such as carboxy starch, carboxynitrophenyl starch and urea-aldehyde-starch reaction products; gelatin hardened with a known hardener; and hardened gelatin as hollow particles microencapsulated by coacervate hardening. Examples of an inorganic compound which can be preferably used as matting agent include silicon dioxide, titanium dioxide, magnesium dioxide, aluminum oxide, barium sulfate, calcium carbonate, silver chloride and silver bromide desensitized by a known method, glass and diatomaceous earth. Different types of materials among the matting agents recited above can be mixed and used, if desired. The matting agent used in the invention has no particular restriction on the size and shape. In putting the invention into practice, although the matting agent may have any particle size, it is preferable for the particle size to be from 0.1 to 30 $\mu$m. In addition, the particle size distribution of the matting agent used may be narrow or broad. However, the matting agent has great influence upon the haze and the surface gloss of coated film. Therefore, it is desirable that the particle size, the shape and the size distribution be adjusted to the desired ones at the time the matting agent is prepared or by mixing two or more matting agents.

In the invention, it is desirable that the backing layer have a matte degree of 10 to 1,200 seconds, preferably 50 to 700 seconds, expressed in terms of Bekk smoothness.

It is favorable to the present image recording materials that the matting agent be present in the outermost layer or a layer functioning as the outermost layer, or a layer close to the outer surface, or a layer acting as the so-called protective layer.

The binder suitable for the present backing layer is a transparent or translucent, generally colorless, film forming material, including natural polymers and synthetic homo- or copolymers. Examples of such a material include gelatin, gum arabic, polyvinyl alcohol, hydroxyethyl cellulose, cellulose acetate, cellulose acetate butyrate, polyvinyl pyrrolidone, casein, starch, polymethacrylic acid, copoly (styrene-maleic anhydride), copoly(styrene-acrylonitrile), copoly(styrenebutadiene), polyvinyl acetals (such as polyvinyl formal and polyvinyl butyral), polyesters, polyurethanes, phenoxy resin, polyvinylidene chloride, polyepoxides, polycarbonates, polyvinyl acetate, cellulose esters and polyamides. The binder may form a film in water, an organic solvent or an emulsion.

It is desirable that the present backing layer have the maximum absorption of 0.3 to 2, preferably 0.5 to 2, in the intended wavelength region and, after processing, be a layer having an absorption of 0.001 to below 0.5 in the visible region, preferably an optical density of 0.001 to below 0.3. Examples of an antihalation dye usable in the backing layer include the same dyes as recited above with respect to the antihalation layer.

In addition, the backside resistive heating layer as disclosed in U.S. Pat. No. 4,460,681 or 4,374,921 can be applied to the present photosensitive photothermographic image system.

Each of the present image-forming layer, protective layer, backing layer and other constituent layers may contain a hardener. The hardening methods and the hardeners usable therein are described in T.H. James, *THE THEORY OF THE PHOTOGRAPHIC PROCESS*, FOURTH EDITION, pages 77–87, Macmillan Publishing Co., Inc., New York (1977), and the polyvalent metal ions described in T.H. James, supra, page 77, the polyisocyanates disclosed in U.S. Pat. No. 4,281,060 and JP-A-6-208193, the epoxy compounds disclosed in U.S. Pat. No. 4,791,042 and the vinylsulfone compounds disclosed in JP-A-62-89048 are favorably used as hardeners.

The hardeners are added as a solution. The time the hardener solution is added to a coating solution for the protective layer is in the period from 180 minutes to just before the coating, preferably from 60 minutes to 10 seconds before the coating. As to the method and conditions for mixing those solutions, the invention has no particular restriction so far as it can fully achieve its effects. For instance, one can adopt the method of mixing solutions by the use of a tank enabling the adjustment of an average staying time to the intended time, wherein the average staying time is calculated from the addition flow rate and the amount of solution fed to a coater, and the method of using a static mixer as described in *Ekitai Kongo Gijutsu* (English equivalent of which is "The techniques for mixing liquids"), the Japanese version (translated by Koji Takahashi) of the original written by N. Harnby, M. F. Edwards & A. W. Nienow, chapter 8, (published by Nikkan Kogyo Shinbunsha in 1989).

For the purpose of improving coating properties and antistatic properties, the invention may use a surfactant. The surfactant can be selected properly from nonionic, anionic, cationic or fluorine-containing surfactants. Suitable examples of such surfactants include the fluoropolymer surfactants disclosed in JP-A-62-170950 and U.S. Patent 5,380,644, the fluorine-containing surfactants disclosed in JP-A-60-244945 and JP-A-63-188135, the polysiloxane surfactants disclosed in U.S. Pat. No. 3,885,965, the polyalkylene oxides disclosed in U.S. Pat. No. 3,885,965, and anionic surfactants.

Examples of a solvent usable in the invention include the solvents described in *Shinpan Yozai Pocketbook* (which means "Newly published pocketbook on solvents"), Ohme Co., Ltd. (1994). However, these examples should not be construed as limiting the scope of the invention. The appropriate boiling point of the solvents used in the present invention is from 40° C. to 180° C.

For instance, hexane, cyclohexane, toluene, methanol, ethanol, isopropanol, acetone, methyl ethyl ketone, ethyl acetate, 1,1,1-trifluoroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine and water can be used as solvents in the invention.

The photographic emulsions for heat development in the invention can be coated on various types of supports. Typical examples of a support usable in the invention include a polyester film, a polyester film with an undercoat, a polyethylene terephthalate film (PET film), a polyethylene naphthalate film, a cellulose nitrate film, a cellulose ester film, a polyvinyl acetal film, a polycarbonate film, materials relating to these films or resinous materials, glass, paper and metal sheets. In particular, flexible base materials, including the paper coated with baryta and/or a partially acetylated $\alpha$-olefin polymer, especially a polymer of $\alpha$-olefin containing 2–10 carbon atoms, such as polyethylene, polypropylene or ethylene-butene copolymers, can be used to advantage. Those supports may be transparent or opaque, but transparent ones are preferred.

The present image recording materials may have an antistatic or conductive layer, such as a layer containing a soluble salt (e.g., chloride, nitrate), an evaporated metal layer or a layer containing the ionic polymer as disclosed in U.S. Pat. Nos. 2,861,056 and 3,206,312 or the insoluble inorganic salt as disclosed in U.S. Pat. No. 3,428,451.

In producing color images by the use of present image recording materials, the methods disclosed in JP-A-7-13295, from page 10, left column, line 43, to page 11, left column, line 40, can be adopted. Therein, the color dye image stabilizers as disclosed in British Patent 1,326,889 and U.S. Pat. Nos. 3,432,300, 3,698,909, 3,574,627, 3,573,050, 3,764,337 and 4,042,394 can be utilized.

In preparing the present image recording materials, any coating method may be employed. Specifically, various coating operations, such as extrusion coating, slide coating curtain coating, dip coating, knife coating, flow coating and the extrusion coating with the hopper disclosed in U.S. Pat. No. 2,681,294, can be applied. Of these coating operations, the extrusion and slide coating operations described in Stephen F. Kistler & Petert M. Schweizer, *LIOUID FILM COATING*, pages 399–536, CHAPMAN & HALL Co. (1997), particularly the slide coating operations, are preferred over the others. An example of the shape of a slide coater usable in the slide coating is illustrated in Stephen F. Kistler et al., supra, FIG. 11*b*. 1 on page 427. Further, two or more layers can be coated simultaneously using the methods described in Stephen F. Kistler et al., supra, pages 399–536, U.S. Pat. No. 2,761,791 and British Patent 837, 095.

It is preferred that the coating solution such as an image forming layer and a protective layer is filtered off by means of a filter (e.g., stainless steel woven metal wire, PPE cartridge PPECG30S manufactured by Fuji Photo Film Co., Ltd. and ULTIPLEAT•PROFILE•FILTER•CARTRIDGE Grades 500, 200, 100 and 700 manufactured by PALL CORPORATION) before coating.

Into the present image recording materials, additional layers can be inserted. Examples of such layers include a dye receiving layer for receiving a transfer dye image, an opacity providing layer in the case of applying the materials to reflection printing, a protective topcoat layer and a primer layer known in the photothermo photography. It is desirable that the image formation in the invention be effected using one image recording material alone. In other words, it is desirable for the functional layers necessary for image formation, such as an image receiving layer, not to constitute another material.

When the present image recording materials are stored in a moistureproof bag, it is preferred to maintain the temperature and humidity conditions in the bags to 25° C. and 10%RH to 55%RH from the standpoint of a long-term storage.

The present photosensitive image recording materials may be developed in any manners. In general, the imagewise exposed photosensitive image recording materials are developed by rising the temperature. The suitable development temperature is from 80° C. to 250° C., preferably from 100° C. to 140° C. The suitable development time is from 1 to 180 seconds, preferably from 10 to 90 seconds.

Any methods can be applied to the exposure of the present photosensitive image recording materials. However, it is desirable to use laser beams as light source for exposure. Examples of laser beams suitable for the present image recording materials include the beams from gas laser, YAG laser, dye laser and semiconductor laser devices. In addition, the combination of semiconductor laser and a second harmonic producing element can also be used.

The present photosensitive image recording materials are low in haze upon exposure, and tend to generate interference fringes. As the arts for preventing the generation of interference fringes, there are known the technique to irradiate a photosensitive image recording material with laser beams incident thereon from an oblique direction, which is disclosed in, e.g., JP-A-5-113548, and the art of utilizing multi-mode laser disclosed in WO 95/31754. The use of these arts is advantageous to the invention.

In the exposure of the present photosensitive image recording materials, it is desirable that the scanning lines be made invisible by scanning laser beams so as to overlap with each other, as disclosed in SPIE vol. 169, "Laser Printing", pages 116–128 (1979), JP-A-4-51043 and WO 95/31754.

The present invention will now be illustrated in greater detail by reference to the following examples. However, the invention should not be construed as being limited to these examples.

EXAMPLE 1

Preparation of PET Support

PET was prepared from terephthalic acid and ethylene glycol in a conventional manner. The intrinsic vicosity IV of the PET obtained was 0.66 (measured at 25° C. in a 6:4 by weight mixture of phenol and tetrachloroethane). The PET was formed into pellets, dried for4hours at 130° C., and then fused at 300° C. The fused PET was extruded from a T-die, and cooled rapidly to prepare an unstretched film having a thickness so as to be 175 $\mu$m after thermal fixation.

The thus prepared film was stretched 3.3 times in the vertical direction by means of rollers differing in peripheral speed, and then stretched 4.5 times in the traverse direction on a tenter. The temperatures during these stretching operations were 110° C. and 130° C. respectively. Thereafter, thermal fixation was carried out for 20 seconds at 240° C., and then 4% relaxation was made in the traverse direction under the same temperature. Further, the fastener part of the tenter was slit, both edges of the film underwent a knurl process, and then the film was wound under a tension of 4 kg/cm$^2$ into a roll. In this way, a roll of film having a thickness of 175 $\mu$m was obtained.

Surface Corona Processing

Both sides of the support were processed at a rate of 20 m/min under room temperature by means of a solid state corona processor, Model 6KVA, made by Pillar Co. From the electric current and voltage values read off during the corona discharge, it was found that the support underwent the processing of 0.375 kV·A·min/m$^2$. Therein, the processing frequency was 9.6 kHz, and the gap clearance between the electrode and the dielectric roll was 1.6 mm.

Production of Support provided with Undercoat (Preparation of coating Solution A for undercoat)

To 200 ml of an aqueous dispersion of ester copolymer, Pesresin A-515GB (30 weight %, produced by Takamatsu Oil & Fat Co., Ltd.), 1 g of polystyrene fine particles (average size: 0.2 $\mu$m) and 20 ml of Surfactant 1 (1 weight %) were added. Further, water was added to the dispersion to make 1,000 ml. Thus, the coating Solution A for undercoat was prepared. (Preparation of coating Solution B for undercoat)

To 680 ml of distilled water, 200 ml of an aqueous dispersion of styrene-butadiene copolymer (styrene/butadiene/itaconic acid =47/50/3 by weight; concn.: 30 weight %) and 0.1 g of polystyrene fine particles (average size: 2.5 $\mu$m) were added. Further, distilled water was added to the dispersion to make 1,000 ml. Thus, the coating Solution B for undercoat was prepared.

(Preparation of coating Solution C for undercoat)

Inert gelatin in an amount of 10 g was dissolved in 500 ml of distilled water, and thereto was added 40 g of the aqueous dispersion (40 weight %) of tin oxide-antimony oxide complex fine grains disclosed in JP-A-61-20033. Further, distilled water was added to the dispersion to make 1,000 ml. Thus, the coating Solution C for undercoat was prepared.

(Production of support provided with undercoats)

The support which had undergone the corona discharge processing was coated with the Coating Solution A at a wet coverage of 5 ml/m$^2$ by means of a bar coater, and dried for 5 minutes at 180° C. The dry thickness of the undercoat was about 0.3 $\mu$m. Then, the support was subjected to the corona discharge on the back side, and then coated with the Coating Solution B at a wet coverage of 5 ml/m$^2$ by means of a bar coater, followed by 5 minutes drying at 180° C. to give the coating a dry thickness of about 0.3 $\mu$m. Further thereon, the Coating Solution C was coated with a bar coater at a wet coverage of 3 ml/m$^2$, and dried for 5 minutes at 180° C. to have a dry thickness of about 0.03 $\mu$m. Thus, the support provided with undercoats was produced.

Preparation of Organic acid Silver Salt Dispersion

Behenic acid made by Henkel Co. (product name: Edenor C22-85R) in an amount of 43.8, 730 ml of distilled water and 60 ml of tert-butanol were mixed with stirring at 79° C., and thereto 117 ml of a IN aqueous NaOH solution was added over a 55-minute period. Therein, the reaction was run for 240 minutes. Thereto, 112.5 ml of an aqueous solution containing 19.2 g of silver nitrate was further added over a 45-second period, and allowed to stand for 20 minutes. After the temperature of the reaction mixture was cooled to 30° C., the solid matter was filtered off with suction, and washed till the electric conductivity of the filtrate became 30 $\mu$S/cm. The thus obtained solid matter was handled as wet cake without being dried. To the wet cake in the amount corresponding to 100 g on a dry basis, 7.4 g of polyvinyl alcohol (trade name: PVA-205) and water were added to make the total weight 385 g, and then subjected to preliminary dispersion with a homomixer.

Next, the preliminarily dispersed admixture was processed three times with a dispersing machine, Microfluidizer M-110S-EH (trade name, made by Microfluidex International Cooperation), wherein a G10Z interaction chamber was used, under the pressure adjusted to 1750 kg/cm$^2$. Thus, a behenic acid silver Dispersion B was obtained. The behenic acid silver grains in the Dispersion B were acicular crystals having an average width of 0.04 $\mu$m, an average length of 0.8 $\mu$m and a variation coefficient of 30%. The measurement of grain sizes was carried out with a Master Sizer X made by Malvern Instruments Ltd. The dispersion temperature was adjusted to the intended temperature by controlling the coolant temperature with coiled heat exchangers fitted on the front and the rear of the interaction chamber respectively.

Preparation of 25 weight % Dispersion of Reducing Agent

Water in an amount of 176 g was added to 80 g of 1,1-bis(2-hydroxy-3,5-dimethylphenyl-3,5,5-trimethylhexane and 64 g of a 20 weight % aqueous solution of modified polyvinyl alcohol, Poval MP203 (trade name, produced by Kurary Co., Ltd.), and mixed thoroughly into slurry. The slurry was placed in a vessel together with 800 g of zirconia beads having an average diameter of 0. 5 mm, and dispersed for 5 hours with a dispersing machine, 1/4G Sand Grinder Mill (made by Aimex Co.). The reducing agent grains in the thus prepared dispersion had an average size of 0.72 $\mu$m.

Preparation of 20 weight % Dispersion of Mercapto Compound

Water in an amount of 224 g was added to 64 g of 3-mercapto-4-phenyl-5-heptyl-1,2,4-triazole and 32 of a 20 weight % aqueous solution of modified polyvinyl alcohol, Poval MP203 (trade name, produced by Kurary Co., Ltd.), and mixed thoroughly into slurry. The slurry was placed in a vessel together with 800 g of zirconia beads having an average diameter of 0.5 mm, and dispersed for 10 hours with a dispersing machine, 1/4G Sand Grinder Mill (made by Aimex Co.). The mercapto compound grains in the thus prepared dispersion had an average size of 0.67 $\mu$m.

Preparation of Methanol Solution of Phthalazine Compound

6-Isopropylphthalazine in an amount of 26 g was dissolved in 100 ml of methanol.

Preparation of 20 weight % Dispersion of Pigment

Water in an amount of 250 g was added to 60 g of C.I. Pigment Blue and 6.4 g of Demol N (trade name, produced by Kao Co., Ltd.), and mixed thoroughly into slurry. The slurry was placed in a vessel together with 800 g of zirconia beads having an average diameter of 0.5 mm, and dispersed for 25 hours with a dispersing machine, 1/4G Sand Grinder Mill (made by Aimex Co.). The pigment grains in the thus prepared dispersion had an average size of 0.21 $\mu$m.

Preparation of Silver Halide Grains (1)

In a reaction jar made of titanium-coated stainless steel, 6.7 ml of a 1 weight % potassium bromide solution was added to 1421 ml of distilled water, and thereto 8.2 ml of 1N nitric acid and 21.8 g of phthaloylated gelatin were added, and kept at 35° C. with stirring. A solution (a1) was prepared by dissolving 37.94 g of silver nitrate in distilled water and adjusting the volume to 159 ml, and a solution (b1) was prepared by dissolving 32.6 g of potassium bromide in distilled water and adjusting the volume to 200 ml. These two solutions (a1) and (b1) were added to the solution in the reaction jar so that the pAg was kept at 8.1 in accordance with a controlled double jet method. Therein, the total volume of the solution (a1) was added at a constant flow rate over a 1-minute period. To the resulting reaction solution, 30 ml of a 3.5 weight % aqueous solution of hydrogen peroxide was added, and then 33.6 ml of a 3 weight % aqueous solution of benzimidazole was further added. Furthermore, a solution (a2) was prepared by diluting the solution (a1) to 317.5 ml with distilled water, and a solution (b2) was prepared by dissolving dipotassium hexachloroiridate in the solution (b1) and diluting with distilled water to 400 ml, wherein the amount of the irridate used was adjusted so as to be $1\times10^{-6}$ mole per mole of silver in the finished silver halide emulsion. These two solutions (a2) and (b2) were also added to the reaction solution in the reaction jar so that the pAg was kept at 8.1 in accordance with a controlled double jet method. Therein, the total volume of the solution (a2) was added at a constant flow rate over a 10-minute period. To the resulting solution, 50 ml of a 0.5 weight % methanol solution of 2-mercapto-5-methylbenzimidazole was added, and further the pAg was raised to 7.5 by the addition of silver nitrate and the pH was adjusted to 3.8 with 1N sulfuric acid. At this stage, the stirring operation was stopped. Then, the sedimentation, desalting and washing treatments were carried out, and 3.5 g of deionized gelatin and 1N sodium hydroxide were further added to adjust the pH to 6.0 and the pAg to 8.2, thereby preparing a silver halide emulsion.

The grains in the thus prepared silver halide emulsion were pure silver bromide grains having an average equivalent diameter of 0.031 μm and a variation coefficient of 11% with respect to the equivalent diameter distribution. These values of the emulsion grains were determined by the observation under an electron microscope, and therein the average of the values of 1,000 grains was taken. The proportion of {100} grains worked out to 85% using the Kubelka-Munk method.

The emulsion prepared was heated up to 50° C. with stirring, and thereto were added 5 ml of a 0.5 weight % methanol solution of N,N'-dihydroxy-N",N"-diethylmalamine and 5 ml of a 3.5 weight % methanol solution of phenoxyethanol. After a lapse of one minute, sodium benzenethiosulfate was further added to the resulting emulsion in an amount of $3\times10^{-5}$ mole per mole silver. Two minutes later, the solid particles of spectral sensitizing dye (1) dispersed in an aqueous gelatin solution were further added in an amount of $5\times10^{-3}$ mole per mole silver. Further two minutes later, a tellurium compound (illustrated hereinafter) was added in an amount of $5\times10^{-5}$ mole per mole silver. The resulting emulsion was ripened for 50 minutes. Just as the ripening was finished, 2-mercapto-5-methylbenzimidazole was added to the emulsion in an amount of $1\times10^{-3}$ mole per mole silver, and the temperature of the resulting emulsion was cooled down to complete the chemical sensitization. Thus, the intended silver halide grains (1) were obtained.

Preparation of Silver Halide Grains (2)

Phthaloylated gelatin in an amount of 22 g and 30 mg of potassium bromide were dissolved in 700 ml of water, and adjusted to pH 5.0 at 35° C. Thereto, 159 ml of an aqueous solution containing 18.6 g of silver nitrate and 0.9 g of ammonium nitrate and an aqueous solution containing potassium bromide and potassium iodide in a ratio of 92:8 by mole were added over a period of. 10 minutes as the pAg was kept at 7.7 in accordance with a controlled double jet method. Then, 476 ml of an aqueous solution containing 55.4 g of silver nitrate and 2 g of ammonium nitrate and an aqueous solution containing $1\times10^{-5}$ mole/l of dipotassium hexachloroiridate and 1 mole/l of potassium bromide were further added over a period of 30 minutes as the pAg was kept at 7.7 in accordance with a controlled double jet method. Thereafter, 1 g of 4-hydroxy-6-methyl-1,3,3a,7-tetrazaindene was added, and then the pH of the resulting reaction mixture was lowered to cause flocculation. The thus desalted emulsion was mixed with 0.1 g of phenoxyethanol, and the pH and the pAg were adjusted to 5.9 and 8.2 respectively. Thus, silver iodobromide cubic grains (iodide content: 8 mole % in the core and 2 mole % on the average; average grain size: 0.05 μm; projected area diameter variation coefficient: 8%; proportion of {100} grains: 88%) were prepared.

The thus prepared silver halide grains were heated up to 60° C., and thereto were added 85 u mole/mole Ag of sodium thiosulfate, $1.1\times10^{-5}$ mole/mole Ag of 2,3,4,5,6-penta-fluorophenyldiphenylphosphine selenide, $1.5\times10^{-5}$ mole/mole Ag of tellurium compound (illustrated hereinafter), $3.5\times10^{-8}$ mole/mole Ag of chloroauric acid and $2.7\times10^{-4}$ mole/mole Ag of thiocyanic acid. The resulting emulsion was ripened for 120 minutes, and then the temperature thereof was cooled rapidly to 40° C. Thereto, $1\times10^{-4}$ mole per mole Ag of spectral sensitizing dye (1) and $5\times10^{-4}$ mole per mole Ag of 2-mercapto-5-methylbenzimidazole were added, and cooled rapidly to 30° C. Thus, the intended silver halide emulsion grains (2) were obtained.

Preparation of Coating Composition for Emulsion Layer

The organic silver salt dispersion in an amount of 103 g was mixed with 5 g of a 20 weight % of aqueous solution of polyvinyl alcohol, PVA-205 (trade name, a product of Kuraray Co., Ltd.), and kept at40° C. Thereto, 23.2 g of the 25 weight % of reducing agent dispersion, 1.2 g of the 20 weight % aqueous dispersion of C.I. Pigment Blue 60 and 3.1 g of the 20 weight % dispersion of mercapto compound were added. To the resulting admixture, 106 g of a 40 weight % SBR latex, which had been purified by ultrafiltration as the temperature was kept at40° C., was added and stirred thoroughly. Then, 6 ml of the methanol solution of phthalazine compound was further added to prepare an organic silver salt containing composition. Just before the composition was coated, the homogeneous mixture of 5 g of the silver halide grains (1) with 5 g of the silver halide grains (2) was mixed with the organic acid silver containing composition by means of a static mixer. The thus prepared coating composition for an emulsion layer was fed to a coating die so as to achieve the silver coverage of 1.4 g/m$^2$.

The viscosity of the coating composition was 85 [mPa·s], measured at 40° C. with a B-type viscometer made by Tokyo Keiki (No.1 Rotor). The viscosities measured at 25° C. with an RFS froude spectrometer made by Rheometric Far East Inc. at shear rates of 0.1, 1, 10, 100 and 1,000 [l/sec] were 1,500, 220, 70, 40 and 20 [mPa·s] respectively.

Additionally, the SBR latex purified by ultrafiltration was obtained as follows: The SBR latex described below was diluted 10 times with distilled water, and purified with a UF-purification module FS03-FC-FUY03A1 (made by Daicen Membrane System Co., Ltd.) till the ionic conductivity came to 1.5 mS/cm. The latex concentration therein was 40 weight %.

(SBR Latex: -St(68)-Bu(29)-AA(3)-Latex)

Average particle size: 0.1 μm; Equilibrium moisture content under the atmosphere of 20° C.–60% RH: 0.6 weight %; Concentration: 45 weight %; Ionic conductivity: 4.2 mS/cm (the measurement of which was carried out at 25° C. using the raw latex (40 weight %) and a conductometer CM-30S made by Toa Denpa Kogyo Co., Ltd.); and pH: 8.2.

Preparation of Coating Composition for Interlayer on Emulsion Side

To a mixture of 772 g of a 10 weight % aqueous solution of polyvinyl alcohol PVA-205 (produced by Kuraray Co., Ltd.) with 226 g of a 27.5 weight % solution of methyl methacrylate/styrene/2-ethylhexyl acrylate/hydroxyethyl methacrylate/acrylic acid (59/9/26/5/1 by weight) copolymer latex, 2 ml of a 5 weight % aqueous solution of Aerosol OT (produced by American Cyanamide Inc.), 4 g of benzyl alcohol, 1 g of 2,2,4-trimethyl-1,3-pentanediol monoisobutyrate and 10 mg of benzoisothiazoline were added to prepare a coating composition for an interlayer. The thus prepared coating composition was fed to a coating die so as to have a coverage of 5 ml/m$^2$.

The viscosity of the coating composition was 21 [mPa s], measured at 40° C. with a B-type viscometer (No.1 Rotor).

Preparation of Coating Composition for First Protective Layer on Emulsion Side (Coating composition for first protective layer)

To 80 g of inert gelatin dissolved in water, 138 ml of a 10 weight % methanol solution of phthalic acid, 28 ml of 1N sulfuric acid, 5 ml of a 5 weight % aqueous solution of Aerosol OT (produced by American Cyanamide Inc.) and 1 g of phenoxyethanol were added. Thereto, water was further added to make the total weight 1,000 g. The thus prepared coating composition for the first protective layer was fed to a coating die so as to have a coverage of 10 ml/$M^2$.

The viscosity of the coating composition was 17 [mPa s], measured at 40° C. with a B-type viscometer (No.1 Rotor).

Preparation of Coating Composition for Second Protective Layer on Emulsion Side (Coating composition for second protective layer)

To 100 g of inert gelatin dissolved in water, 20 ml of a 5 weight % solution of N-perfluorooctylsulfonyl-N-propylalanine potassium salt, 16 ml of a 5 weight % aqueous solution of Aerosol OT (produced by American Cyanamide Inc.), 25 g of polymethyl meethacrylate fine particles (average size: 4.0 $\mu$m), 44 ml of 1N sulfuric acid, and 10 mg of benzoisothiazoline were added. Thereto, water was further added to make the total weight 1,555 g. Just before the admixture was coated, 445 ml of an aqueous solution containing 4 weight % of chrome alumn and 0.67 weight % of phthalic acid was mixed with the foregoing composition by means of a static mixer. The thus prepared coating composition for the second protective layer was fed to a coating die so as to have a coverage of 10 ml/$M^2$.

The viscosity of the coating composition was 9 [mPa·s], measured at 40° C. with a B-type viscometer (No.1 Rotor).

Preparation of Coating Compositions on Back side (Preparation of finely divided solid base precursor dispersion)

A mixture of 64 g of a base precursor compound (illustrated hereinafter), 10 g of a surfactant, Demol N (produced by Kao Co., Ltd.) and 246 ml of distilled water was dispersed with beads and a sand mill (1/4 Gallon Sand Grinder Mill, made by Aimex Co.). Thus, a finely divided solid base precursor dispersion having an average particle size of 0.2 $\mu$m was obtained.

(Preparation of finely divided solid dye dispersion)

A mixture of 9.6 g of a cyanine dye compound (illustrated hereinafter), 5.8 g of sodium p-alkyllbaenzenesulfonate and 305 ml of distilled water was dispersed with beads and a sand mill (1/4 Gallon Sand Grinder Mill, made by Aimex Co.). Thus, a finely divided solid dye dispersion having an average particle size of 0.2 $\mu$m was obtained.

(Preparation of coating solution for antihalation layer)

Gelatin in an amount of 17 g, 9.6 g of polyacrylamide, 70 g of the finely divided solid base precursor dispersion, 56 g of the finely divided solid dye dispersion, 1.5 g of polymethyl methacrylate fine particles (average size: 6.5 $\mu$m), 2,2 g of sodium polystyrenesulfonate, 0.2 g of a 1 weight % solution of colored dye compound (illustrated hereinafter) and 844 ml of water were mixed to prepare a coating composition for the antihalation layer.

(Preparation of coating composition for protective layer on back side)

In a vessel kept at 40° C., 50 g of gelatin, 0.2 g of sodium polystyrenesulfonate, 2.4 g of N,N'-ethylenebis (vinylsulfonacetamide), 1 g of sodium 1-octylphenoxyethoxyethanesulfonate, 30 mg of benzoisothiazoline, 32 mg of $C_8F_{17}SO_3K$, 64 mg of $C_8F_{17}SO_2N(C_3H_7)(CH_2CH_2O)_4(CH_2)_4\text{-}SO_3Na$ and 950 ml of water were mixed to prepare a coating composition for the protective layer oh the back side.

The structural formulae of the ingredients used above are shown below:

Surfactant (1)

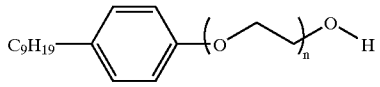

n ≈ 8.5

Spectral Sensitizing Dye (1)

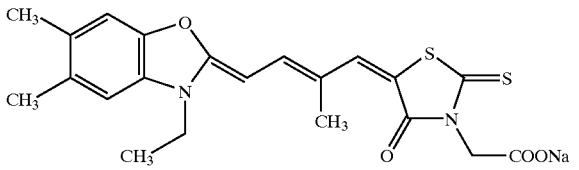

Tellurium Compound

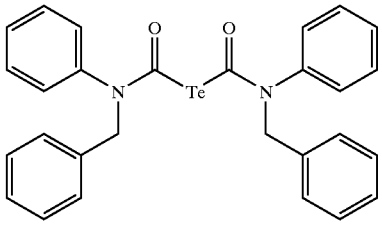

Base Precursor Compound

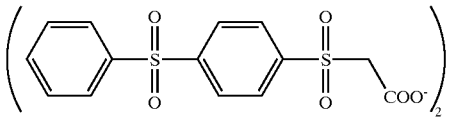

Cyanine Dye Compound

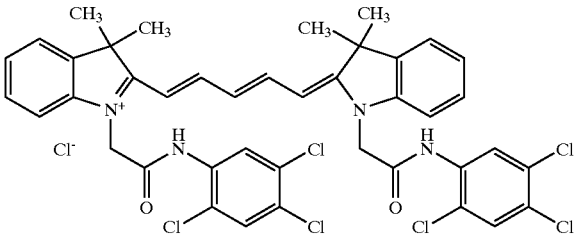

Colored Dye Compound

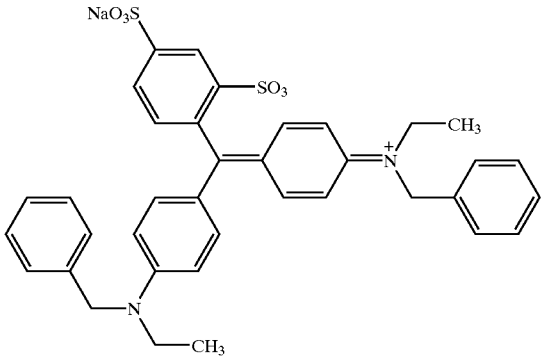

Production of Photothermographic Light-Sensitive Material (Sample No. 1)

To the support provided with undercoats, the coating composition for the antihalation layer and the coating composition for the protective layer were applied using a simultaneous double coating technique so that the antihalation layer had the finely divided solid dye coverage of 0.04 g/m$^2$ and the protective layer had the gelatin coverage of 1 g/m$^2$, followed by drying. Thus, the antihalation backing layer was formed. To the undercoat on the side opposite to the backing layer, the emulsion layer, the interlayer, the first protective layer and the second protective layer were applied in the order of description by the use of a slide bead system of simultaneous multiple coating technique. Thus, the photothermographic light-sensitive material (Sample No. 1) was produced. Additionally, the coating on the emulsion side was carried out without winding the support after the coating on the back side.

Therein, the coating speed was 160 m/min, the gap between the tip of the coating die and the support was 0.18 mm, and the decompression chamber was controlled so as to have the inside pressure lower than the atmospheric pressure by 392 Pa. In the chilling zone subsequent thereto, the wind of 18° C. as dry-bulb temperature and 12° C. as wet-bulb temperature blew for 30 seconds at the speed of 7 m/sec to cool the coating compositions. Thereafter, in the helical type of levitated drying zone, the dry air of 30° C. as dry-bulb temperature and 18° C. as wet-bulb temperature was made to blow from holes for 20 seconds at the speed of 20 m/sec to evaporate the solvents in the coating compositions.

Production of Photothermographic Light-Sensitive Materials (Sample Nos. 2 to 24)

Photothermographic light-sensitive materials (Sample Nos. 2 to 24) were produced in the same manner as the photothermographic light-sensitive material of Sample No.1. Therein, howeve, each of the present compounds set forth in Table 1 or the comparative compounds illustrated below was emulsified and dispersed using an appropriate dispersing aid so that the resulting dispersion had a solid concentration of 20 weight % and added to the prescribed layer. Comparative Compound (1)

Comparative Compound (1)

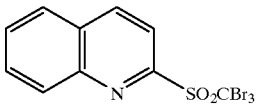

-continued

Comparative Compound (2)

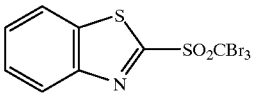

Each of the samples was cut into a size of 36.5 cm ×25.8 cm under 55%-RH.

(Evaluation of Photographic Properties)

Each photosensitive material was exposed to laser beams so that the incident beams formed an angle of 30° to the normal line with a 647 nm Kr laser sensitometer (maximum outpur: 500 mW), and then processed (developed) for 25 seconds at 120° C. The images obtained were examined with a densitometer. The measurements results were evaluated by the minimum density (Dmin). Each of the ΔD values set forth in Table 1 was a difference in Dmin between each Sample and Sample No. 6 taken as the standard sample. Specifically, when Dmin is greater than that of the standard sample, ΔD is a positive value; while, when Dmin is smaller than that of the standard sample, ΔD is a negative value.

(Evaluation of image keeping quality under exposure)

The photosensitive materials which had underwent the same exposure and development processing as in the case of evaluating photographic properties were each pasted to the inside of the glass window exposed directly to the sun, and allowed to stand for 1 month. The state of the images was evaluated by visual observation according to the following criterion. The results obtained are shown in Table 1.

◎ . . . Almost no change was observed.

○ . . . There was a slight change in tone but the change was on the practically allowable level.

Δ . . . The Dmin section was changed to brown, and this brown stain was below the practically allowable level.

X . . . The Dmin and medium density sections changed their colors and the densities thereof were increased, and these changes were far below the practically allowable level.

(Evaluation of image keeping quality under high temperature in the dark)

The photosensitive materials which had underwent the same exposure and development processing as in the case of evaluating photographic properties were allowed to stand for 1 month at a temperature of 40° as they were shielded from light. The state of the images was evaluated by visual observation according to the following criterion. The results obtained are shown in Table 1.

◎ . . . Almost no change was observed.

○ . . . There was a slight change in tone but the change was on the practically allowable level.

Δ . . . The Dmin section was changed to brown, and this brown stain was below the practically allowable level.

X . . . The Dmin and medium density sections changed their colors and the densities thereof were increased, and these changes were far below the practically allowable level.

TABLE 1

| | Compound added | | | | Image keeping quality | |
|---|---|---|---|---|---|---|
| Sample No. | Compound | Location added | amount added (×10$^{-4}$ mol/m$^2$) | ΔD | under exposure | at high temp. in the dark |
| 1 (comparison) | — | — | — | +0.6 | X | X |
| 2 (comparison) | Comparative Compound (1) | emulsion layer | 5.0 | +0.01 | X | Δ |
| 3 (comparison) | Comparative Compound (1) | interlayer | 5.0 | +0.03 | Δ | X |

TABLE 1-continued

| | Compound added | | | | Image keeping quality | |
|---|---|---|---|---|---|---|
| Sample No. | Compound | Location added | amount added ($\times 10^{-4}$ mol/m$^2$) | ΔD | under exposure | at high temp. in the dark |
| 4 (comparison) | Comparative Compound (2) | emulsion layer | 8.0 | +0.02 | X | Δ |
| 5 (comparison) | Comparative Compound (2) | 1st protective layer | 16.0 | +0.05 | Δ | X |
| 6 (invention) | present Compound 7-1 | emulsion layer | 5.0 | 0 (standard) | ○ | ◎ |
| 7 (invention) | present Compound 7-1 | interlayer | 5.0 | 0 | ○ | ◎ |
| 8 (invention) | present Compound 2-3 | emulsion layer | 8.0 | −0.01 | ○ | ◎ |
| 9 (invention) | present Compound 2-3 | 1st protective layer | 16.0 | +0.01 | ◎ | ○ |
| 10 (invention) | present Compound 1-3 | emulsion layer | 2.5 | +0.01 | ○ | ○ |
| 11 (invention) | present Compound 1-3 | emulsion layer | 5.0 | 0 | ◎ | ◎ |
| 12 (invention) | present Compound 1-3 | emulsion layer | 15.0 | −0.01 | ◎ | ◎ |
| 13 (invention) | present Compound 1-3 | interlayer | 15.0 | −0.01 | ◎ | ◎ |
| 14 (invention) | present Compound 3-1 | emulsion layer | 15.0 | 0 | ○ | ○ |
| 15 (invention) | present Compound 3-1 | interlayer | 15.0 | 0 | ○ | ○ |
| 16 (invention) | present Compound 5-2 | emulsion layer | 5.0 | −0.01 | ○ | ○ |
| 17 (invention) | present Compound 5-2 | emulsion layer | 15.0 | −0.02 | ○ | ○ |
| 18 (invention) | present Compound 1-12 | emulsion layer | 5.0 | −0.10 | ◎ | ○ |
| 19 (invention) | present Compound 1-12 | emulsion layer | 15.0 | −0.02 | ◎ | ◎ |
| 20 (invention) | present Compound 6-2 | emulsion layer | 5.0 | +0.01 | ◎ | ○ |
| 21 (invention) | present Compound 6-2 | emulsion layer | 15.0 | 0 | ◎ | ◎ |
| 22 (invention) | present Compound 8-1 | emulsion layer | 15.0 | +0.01 | ◎ | ○ |
| 23 (invention) | present Compound 8-4 | emulsion layer | 15.0 | 0 | ◎ | ○ |
| 24 (invention) | present Compound 4-4 | emulsion layer | 15.0 | −0.01 | ◎ | ○ |

As can be seen from the results shown in Table 1, the photosensitive materials causing slight changes in image quality upon long-term storage after image formation were obtained by the use of the present compounds.

EXAMPLE 2

Light-sensitive material A was prepared in the same manner as Sample No. 10 in Example II-1 with the exception that the preparation of organic acid silver salts dispersion was changed to ones prepared by the following methods.

Preparation of Fatty Acid Silver Salt A

Behenic acid (trade name: Edenor C22-85R) (87.6 g) manufactured by Henckel Co., 423 ml of distilled water, 49.2 ml of a 5 N aqueous solution of NaOH and 120 ml of tert-butanol were mixed, and stirred at 75° C. for 1 hour to conduct the reaction, thereby obtaining a sodium behenate solution. Separately, 206.2 ml of an aqueous solution containing 40.0 g of silver nitrate (pH 4.0) was prepared, and the temperature thereof was kept at 10° C. A reaction vessel in which 635 ml of distilled water and 30 ml of tert-butanol were placed was kept at a temperature of 30° C., and the sodium behenate solution previously prepared and the aqueous solution of silver nitrate were wholly added thereto at a constant flow rate for 62 minutes and 10 seconds and for 60 minutes, respectively. At this time, only the aqueous solution of silver nitrate was added for 7 minutes and 20 seconds after the start of addition of the aqueous solution of silver nitrate. Thereafter, addition of the sodium behenate solution was started, and only the sodium behenate solution was added for 9 minutes and 30 seconds after addition of the aqueous solution of silver nitrate was completed. At this time, the temperature in the reaction vessel was adjusted to 30° C., and the temperature of the outside was controlled so that the liquid temperature was not elevated. Further, a pipe of an addition system of the sodium behenate solution was lagged with steamed jacket, and the opening of a valve for steam was controlled so that the liquid temperature at an outlet of a tip of an addition nozzle became 75° C. Further, a pipe of an addition system of the aqueous solution of silver nitrate was lagged by circulating cool water in the outer space of a double pipe. A position of adding the sodium behenate solution and a position of adding the aqueous solution of silver nitrate are arranged symmetrically centered on a stirring shaft, and at such a height that they do not come into contact with the reaction solution.

After addition of the sodium behenate solution was completed, the solution was allowed to stand with stirring for 20 minutes at a temperature left as it was, and then, the temperature was lowered to 25° C. Then, solid matter was filtered by suction filtration, and washed with water until a filtrate showed a conductivity of 30 $\mu$S/cm. Thus, fatty acid silver salt A was obtained. The resulting solid matter was not dried and stored as a wet cake.

The shape of the resulting silver behenate particles was evaluated taking electron photomicrographs. As a result, the silver behenate particles were crystals in a scale shape having an average equivalent-sphere diameter of 0.52 $\mu$m, an average long side/short side of 1.5, an average aspect ratio of 5.1, an average particle thickness of 0.14 $\mu$m and a coefficient of variation of equivalent-sphere diameters of 15%.

As a result, the excellent effect of the present invention could be obtained in Light-sensitive material A similar to Sample No. 1 in Example 1.

ADVANTAGES OF THE INVENTION

In accordance with the present invention, image recording materials having low fog and excellent image storage stability can be obtained.

What is claimed is:

1. An image recording material comprising a support and a constituent layer(s) comprising at least (a) a heat-sensitive imaging layer containing a light-insensitive silver salt of an aliphatic carboxylic acid having 10 to 30 carbon atoms, a reducing agent of said light-insensitive silver salt and a binder or (b) a light-sensitive imaging layer containing a light-sensitive silver halide, light-insensitive silver salt of an aliphatic carboxylic acid having 10 to 30 carbon atoms, a reducing agent of said light-insensitive silver salt and a binder, wherein the image recording material comprises a compound represented by formula (1) in at least one constituent layer:

(1)

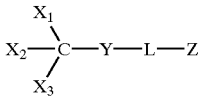

wherein $X_1$ and $X_2$ each represent a halogen atom; $X_3$ represents a hydrogen atom, a halogen atom or a univalent substituent group selected from the group consisting of 1–30C alkyl groups, 6–30C aryl groups, 2–30C alkenyl groups, 2–30C alkynyl groups, a nitro group, a cyano group, a hydroxyl group, a carboxyl group or salts thereof, a sulfo group or salts thereof, an amino group, 1–30C acylamino groups, 1–30C alkylsulfonyl groups 6–30 arylsulfonyl groups, 1–30C alkylsulfonylamino groups 6–30 arylsulfonylamino groups, unsubstituted or substituted carbamoyl groups, unsubstituted or substituted sulfamoyl groups and heterocyclic groups; L represents, an arylene group; Y represents $SO_2$, or a single bond; and Z represents an acidic functional group or a salt thereof.

2. The image recording material according to claim 1, wherein the constituent layer(s) comprises at least (b) a light-sensitive imaging layer.

3. The image recording material according to claim 1, wherein $X_1$ and $X_2$ each represents a bromine atom.

4. The image recording material according to claim 1, wherein $X_3$ represents a bromine atom.

5. The image recording material according to claim 1, wherein Y represents —$SO_2$—.

6. The image recording material according to claim 1, wherein Z represents a carboxyl group or a sulfo group.

7. The image recording material according to claim 1, wherein the compound represented by formula (1-a):

(1-a)

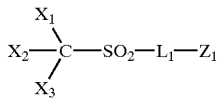

wherein $X_1$, $X_2$ and $X_3$ have the same meanings as in formula (I) respectively, $L_1$ represents a 6–30C arylene group and $Z_1$ represents a carboxyl group or a sulfo group.

8. The image recording material according to claim 1, wherein the compound is contained of 10 mg/m$^2$ to 10 g/m$^2$.

9. The image recording material according to claim 1, wherein the heat-sensitive imaging layer or the light-sensitive imaging layer was provided by coating and drying a coating composition which contains the binder in the state of aqueous latex or polymer dissolved or dispersed in a water-base solvent.

10. The image recording material according to claim 1, wherein L represents an arylene group.

11. The image recording material according to claim 1, wherein Z is an acidic functional group selected from the group consisting of a carboxyl group, a sulfo group and a phosphorus-containing acidic functional group or salts thereof.

12. The image recording material according to claim 11, wherein the salts of the acidic functional groups are selected from the group consisting of alkali metal salts, alkaline earth metal salts, $NR_4^+$ salts, phosphonium salts and sulfonium salts, wherein the R groups may be the same or different and are the same as defined for $X_3$.

* * * * *